US005954470A

United States Patent [19]

Duell et al.

[11] Patent Number: 5,954,470

[45] Date of Patent: Sep. 21, 1999

[54] COMPACTING SYSTEM AND REFUSE VEHICLE

[75] Inventors: Charles A. Duell, Crestline; Thomas E. Pfeifer, Galion; Larry D. Horning, Crestline, all of Ohio

[73] Assignee: Galion Solid Waste Equipment Co, Inc., Galion, Ohio

[21] Appl. No.: 08/771,541

[22] Filed: Dec. 23, 1996

Related U.S. Application Data

[63] Continuation-in-part of application No. 08/562,394, Nov. 24, 1995.

[51] Int. Cl.[6] ..... B65F 3/28

[52] U.S. Cl. ..... 414/525.6; 100/43; 100/50; 414/517; 414/786

[58] Field of Search ..... 414/509–517, 414/525.2, 525.6, 786; 100/43, 48, 50, 51

[56] References Cited

U.S. PATENT DOCUMENTS

| | | | |
|---|---|---|---|
| 3,572,529 | 3/1971 | Anderson | 414/408 |
| 3,765,554 | 10/1973 | Morrison | 414/408 |
| 3,802,335 | 4/1974 | Longo | 100/50 X |
| 3,827,587 | 8/1974 | Liberman et al. | 414/408 X |
| 3,841,508 | 10/1974 | Ebeling et al. | 414/406 |
| 3,999,669 | 12/1976 | Smith | 414/517 |
| 4,057,010 | 11/1977 | Smith | 414/525.6 X |
| 4,057,156 | 11/1977 | Thompson et al. | 414/408 |
| 4,085,857 | 4/1978 | Smith | 414/408 |
| 4,091,944 | 5/1978 | Gollnick | 414/525.6 X |
| 4,173,424 | 11/1979 | Whitehead et al. | 414/517 |
| 4,175,903 | 11/1979 | Carson | 414/408 |
| 4,260,316 | 4/1981 | Gollnick | 414/517 X |
| 4,522,551 | 6/1985 | Henneberry | 414/517 |
| 4,524,582 | 6/1985 | Lucas et al. | 100/48 X |
| 4,538,951 | 9/1985 | Yeazel et al. | 414/407 |
| 4,566,840 | 1/1986 | Smith | 414/408 |
| 4,715,767 | 12/1987 | Edelhoff et al. | 414/408 |
| 4,844,682 | 7/1989 | Edelhoff | 414/408 |
| 4,953,109 | 8/1990 | Burgis | 414/517 X |
| 4,986,074 | 1/1991 | Hahmann et al. | 414/408 |
| 5,015,144 | 5/1991 | Smith et al. | 414/525.2 |
| 5,033,930 | 7/1991 | Kraus | 414/408 |
| 5,049,026 | 9/1991 | Bingman et al. | 414/408 |
| 5,064,332 | 11/1991 | Edelhoff et al. | 414/408 |
| 5,114,304 | 5/1992 | Edelhoff et al. | 414/786 |
| 5,203,669 | 4/1993 | Klossek et al. | 414/525.2 |
| 5,222,853 | 6/1993 | Carson | 414/408 |
| 5,303,642 | 4/1994 | Durbin et al. | 100/50 |
| 5,330,308 | 7/1994 | Armando et al. | 414/408 |
| 5,681,140 | 10/1997 | Christenson | 414/525.6 |

FOREIGN PATENT DOCUMENTS

| | | | |
|---|---|---|---|
| 232602 | 10/1991 | Japan | 414/517 |

OTHER PUBLICATIONS

*10–Solenoid–Valve Control Stick Gives Truck Operator "Extra Hands"*, publication, pp. 117–122 (4 pages).

*Digitrak . . . advanced electronic motion control for open– and closed–center valves*, publication, (8 pages).

(List continued on next page.)

*Primary Examiner*—David A. Bucci

*Attorney, Agent, or Firm*—Niro, Scavone, Haller & Niro

[57] ABSTRACT

An improved compacting system, and an automated refuse vehicle that can employ this compacting system. Alternatively, the compacting system can be used with a stationary packer. The compacting system is capable of placing the packer ram, blade or panel into a creep mode in which, even if the maximum compacting force is applied, the packing ram will generally retain its position without reversing direction for a pre-programmed interval of time. The refuse vehicle also provides a fast-return cycle for an engaged container, and a series of "lock-out" zones to minimize the possibility of damaging the vehicle during automated use. Methods for using the compacting system and for operating the refuse vehicle also form part of the present invention.

16 Claims, 15 Drawing Sheets

OTHER PUBLICATIONS

Peabody International Corp. *Auto–Cycle Installation FLHC*, Drawing No. 20–39084D, Jul. 10, 1978, publication, (1 page).

GarWood® A Division of Sargent Industries, *FL–3000 Front Loader, Engineered For Profit*, publication, (1 page).

Leach® 2–F Front Loader, 1988, publication, (1 page).

*Cobey Front Loaders*, Cobey Waste Control, brochure, (2 pages + fold–over).

Dempster® RFL™ Residential Front Loader, publication, (2 pages).

Photograph: Peabody–Galion "Flex–Arm" Model FL80–HC3323 frontloader with folding arms.

33A
22B
33

26A
26B
24
3
3
22B
33

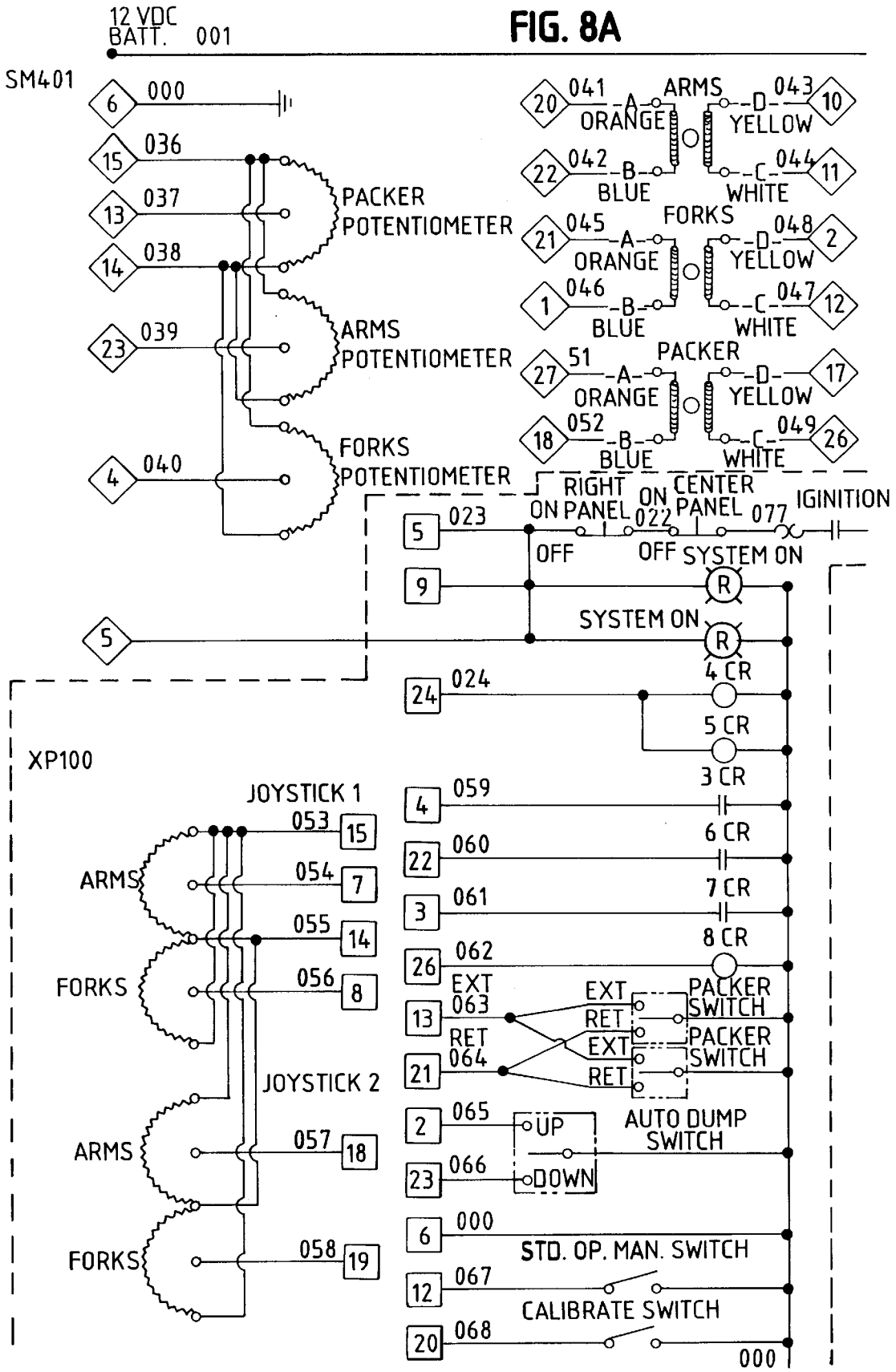
FIG. 8A
12 VDC
BATT. 001
SM401
6 000
15 036
13 037
14 038
23 039
4 040
PACKER POTENTIOMETER
ARMS POTENTIOMETER
FORKS POTENTIOMETER
20 041 A ORANGE
ARMS
D 043 10 YELLOW
22 042 B BLUE
C 044 11 WHITE
21 045 A ORANGE
FORKS
D 048 2 YELLOW
1 046 B BLUE
C 047 12 WHITE
27 51 A ORANGE
PACKER
D 17 YELLOW
18 052 B BLUE
C 049 26 WHITE
5 023
RIGHT ON PANEL
ON 022
CENTER PANEL
077
IGINITION
OFF
OFF
SYSTEM ON
9
SYSTEM ON
5
24 024
4 CR
5 CR
XP100
JOYSTICK 1
4 059
3 CR
053 15
22 060
6 CR
ARMS
054 7
3 061
7 CR
055 14
26 062
8 CR
FORKS
056 8
EXT
13 063
RET
21 064
EXT
RET
EXT
RET
PACKER SWITCH
PACKER SWITCH
JOYSTICK 2
2 065
UP
AUTO DUMP SWITCH
ARMS
057 18
23 066
DOWN
6 000
STD. OP. MAN. SWITCH
FORKS
058 19
12 067
CALIBRATE SWITCH
20 068
000

COMPACTING SYSTEM AND REFUSE VEHICLE

This application is a continuation-in-part of co-pending U.S. Ser. No. 08/562,394, filed Nov. 24, 1995.

BACKGROUND OF THE INVENTION

The invention generally relates to systems and apparatus for lifting and loading materials into storage containers. The invention more particularly relates to an automated vehicular apparatus and method for the collection of waste materials.

In many environments, there is a need to efficiently lift and load large volumes of materials. The collection of waste materials is a good example of one such environment.

The use of curbside waste collection containers is becoming more and more widespread. In one arrangement, waste materials are accumulated by a household in plastic or metal containers. The refuse crew may empty the contents of these containers into waste collection vehicles using specially designed lifting and loading assemblies. By using these relatively large collection containers in association with specially designed lifting and loading assemblies, large volumes of waste materials can be collected in a relatively short period of time, compared to conventional hand-loading operations.

A conventional refuse collection vehicle includes a cab, a body for storing refuse positioned at the rear of the cab, and a container-handling mechanism, (such as a lift arm or boom connected to a container gripper), carried on a wheeled chassis adjacent either the cab or the body. With an automated vehicle, the container-handling mechanism is typically controllably actuated by pressurized hydraulic fluid selectively directed by controls located at the operator's compartment within the cab. Conventionally, the container-handling mechanism includes pivoting forks or opposed gripping members carried at the end of the lifting arm(s) or boom which is extendable and retractable relative to the curb or pick-up side of the vehicle. When the vehicle is brought to a stop, the lifting arm(s) and the associated fork(s) or gripping members engage the container. The container is then elevated through coordinated movement of the lifting arm(s) and/or boom and forks, for example, to position the container adjacent or over a hopper located behind the cab to deposit the refuse.

Lifting and loading mechanisms that engage the container in the front of the waste collection vehicle, known as "frontloaders", are in common use. (Throughout this application, "front" or "forward" will be used to signify the cab-end of the vehicle while "back" or "rearward" will denote the opposite direction of the vehicle.) These mechanisms conventionally have two curved arms that clear the cab in front of the vehicle, connected to a pair of pivoting forks that fit into side or bottom pockets of a steel collection container. Other conventional mechanisms employ a triangular frame in front of the cab that locks into a triangular pocket on the rear face of a collection container. Other types of collection containers can be used, as well.

Another example of a lifting assembly is shown in U.S. Pat. No. 4,715,767 to Edelhoff et. al. Edelhoff discloses a lift arm arranged to pick-up the containers along the side of the cab, generically known as a "sideloader."

Conventional refuse vehicles include a packing blade or ram to periodically compact the refuse within the storage body, permitting larger loads. The specific location of the packing blade is typically not monitored by a feedback control system. Instead, trip switches are conventionally used to detect whether a predetermined "packing point" has been reached by the packing ram; if not, the ram is returned to its original forward or home position, and the operator is apprised of the presence of a full load by an indicator light or other means. It would be advantageous to continuously monitor the packer ram movement, and to maintain a packing pressure on the load at predetermined times, even when the packing point cannot be reached, to increase payloads.

One objective of the present invention is to provide a refuse compacting system with enhanced packing efficiency.

Another object of the present invention is to provide a refuse vehicle with a fast and efficient return-from-dump cycle.

Yet another object is to provide an automated vehicular waste system in which movement of the arms and forks is constantly monitored to avoid undesirable arm or fork motion which might damage the vehicle.

It is also an object to provide an automated refuse vehicle which can handle conventional containers, in addition to those specially designed for automated use.

Another objective is to permit the use of an automated refuse vehicle of the "frontloader" variety that is "low profile" in the sense that the lift arm does not exceed a relatively low, predetermined height "envelope" during lifting and dumping of the container.

Another objective of this invention is to provide a lifting and loading apparatus that performs all primary operations with a single control lever.

Still another objective of this invention is to provide a lifting and loading apparatus that permits the use of a conventional, unmodified cab.

Still other objects will be recognized upon reading the following disclosure.

SUMMARY OF THE INVENTION

These and other objectives are provided by the present invention. One feature of the invention includes a compacting system for use with transportable or stationary packers. Packing means, such as a packing panel(s), blade(s) or ram(s) are adapted to compact refuse deposited within an enclosure. The packing means is preferably capable of extending and retracting between a predetermined packing point and a home position. The compacting system includes a control system for continuously monitoring the rate of movement of the packing means. The packing means is capable of operation in a creep mode in which, if the rate of movement of the packing means is less than a preprogrammed rate of movement, the packing means maintains a compacting force on the refuse in the direction of its original movement for a preselected time period or until the packing point is reached, whichever occurs first, after which the packing means reverses its direction. Preferably, the packing means is operable in the creep mode regardless of whether the packing means is extending or retracting. It is also preferred that the creep mode be disabled if the rate of movement of the packing means increases above the preprogrammed rate of movement before either the preselected time period elapses or the packing point is reached.

In another preferred embodiment, the compacting system of the present invention is used within the environment of the storage body of a refuse vehicle. The storage body has a loading opening for receiving refuse. A packing ram is located within the storage body and is adapted to compact refuse deposited within the body. The packing ram is capable of extending to a pre-programmed packing point and retracting to a home position. A control system is provided for monitoring the movement of the packing ram. The packing ram is also capable of operation in a creep mode in which, if the rate of movement of the packing ram is less than a pre-programmed rate of movement, the packing ram maintains a compacting force on the refuse in the direction of its original movement for a preselected time period or until the packing point is reached, after which the packing ram reverses direction. This embodiment is fully adaptable to refuse vehicles of either the "eject" or "dump" style for removing collected refuse.

In a particularly preferred embodiment, a follower cover is automatically positionable over the loading opening in response to movement (extension) of the packing blade.

A method for compacting refuse within the storage body of a vehicle during refuse collection also forms part of the present invention. This invention includes the step of providing a packing ram located within the storage body and adapted to compact refuse deposited within the storage body. The packing ram is preferably capable of extending to a predetermined packing point and retracting to a home position. A control system is also provided for continuously monitoring the rate of movement of the packing ram. The control system is used to extend the packing ram and begin compacting refuse within the storage body. If the rate of movement of the packing ram is less than a pre-programmed rate of movement, the packing ram is placed in a creep mode in which a compacting force is maintained on the refuse in the direction of its original movement for a preselected time period or until the packing point is reached, whichever occurs first. Then, the direction of the packing ram is reversed, and compaction occurs again in a similar manner of loading refuse within the storage body, the packing ram being retracted to the home position during loading, and being extended to compact refuse when loading is not occurring. Preferably, the packing ram is operable in the creep mode regardless of its direction.

In another preferred embodiment, a refuse vehicle is provided with a storage body and a loading opening for receiving refuse from a container, and at least one packing ram located within the storage body and adapted to compact refuse deposited within the body. At least one arm is connected to the vehicle, and at least one container engaging device (such as a pivoting fork are a container grasping device) is connected to the arm. The arm and container engaging device are adapted to engage the container and are capable of moving the container between an initial load position and a dump position in which the container is located adjacent the loading opening. A control system continuously monitors and controls the movement of each of the at least one packing ram, arm and container engaging device. In a particularly preferred embodiment, actuator cylinders are associated with each of the at least one packing ram, arm and container engaging device, and the control system includes rotary potentiometers which are associated with each of the at least one packing ram, arm and container engaging device. In another preferred embodiment, the control system automatically confines the movement of the at least one arm and container engaging device so that when the container is positioned forward of the cab, neither the arm nor the container engaging device are permitted to contact the cab or the ground; and when the container is positioned adjacent the loading opening, the container is not permitted to contact any portion of the storage body.

In another preferred embodiment, the lift arm is capable of moving the container successively through a dump path from an initial load position in which the container is located at a ground level and a dump position in which the container is located adjacent to the loading opening, and then through a return path in which the container moves from the dump position back to the load position. Preferably, the control system automatically controls the arm movement so that the dump path differs from the return path, and the time period necessary for the container to move through the return path is less than the time period required for the container to move through the dump path. Preferably, the container is maintained in a substantially level position as it moves along the dump path in front of the cab, to avoid refuse spillage onto the cab. In a particularly preferred embodiment, the control system is actuable to automatically move the container through the dump and return paths using a single operator-controlled switch.

In other embodiments, the arm is capable of pivoting about a generally horizontal axis to move the container over the cab, and about a generally vertical axis to move the container transverse to the length of the storage body. Preferably, the arm can be at least partially folded to reduce the overall height of the arm as the container is elevated over the cab, as disclosed in pending U.S. Ser. No. 08/562,394, filed Nov. 24, 1995, incorporated by reference herein.

A method for collecting refuse employing an automated refuse vehicle with a storage body having a loading opening to receive refuse from a container also forms part of the present invention. This method includes the step of providing at least one arm connected to the vehicle and adapted to engage the container, and also providing a control system for continuously monitoring and controlling the movement of the arm. The container is moved, using the control system and the at least one arm, through a dump path between an initial load position in which the container is located at ground level, and a dump position in which the container is located adjacent the loading opening. Refuse is then deposited from the container through the loading opening and into the storage body. The container is again moved, using the control system and the at least one arm, through a return path from the dump position to the load position. The return path differs from the dump path, and requires less time to traverse.

BRIEF DESCRIPTION OF THE DRAWINGS

The novel features of the invention are set forth in the claims. Preferred embodiments of the invention itself, however, together with further objects and attendant advantages, will be best understood by reference to the following description taken in connection with the accompanying drawings in which:

FIGS. 8A–8D are partial schematic views of electrical circuits shown in FIG. 8;

DESCRIPTION OF THE PREFERRED EMBODIMENTS

Figure 1:
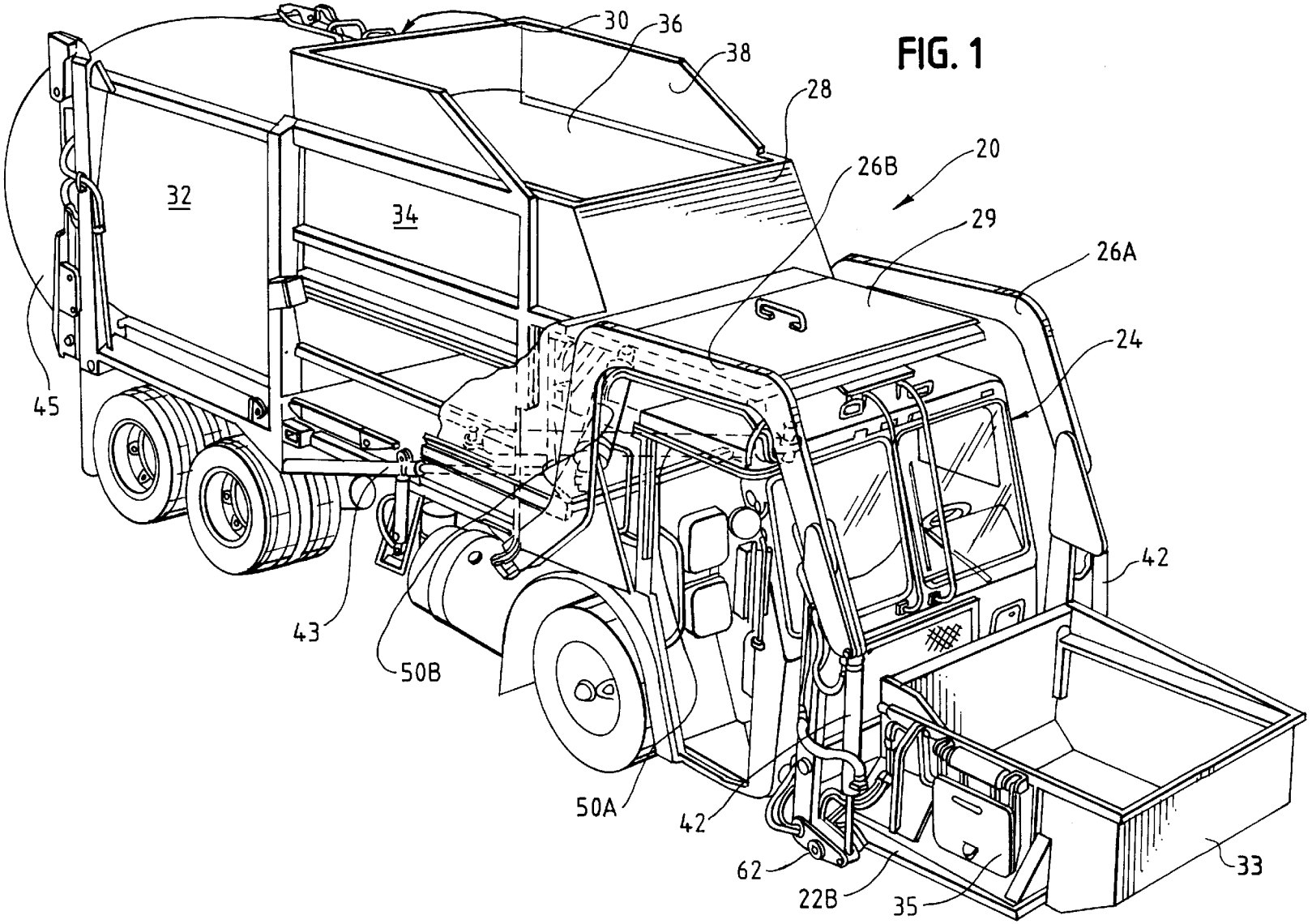
FIG. 1 is a side and front perspective view of a preferred embodiment of the refuse vehicle of the present invention.

Referring now to FIG. 1, a preferred embodiment of the refuse vehicle of the present invention, of the "frontloader" type, is shown. It will be understood that aspects of the invention can be adapted to other vehicles, such as side-loaders. The refuse vehicle is generally designated as 20, and includes a chassis 70, a cab 24, and a body 30 which has a forward section or hopper 34 with a loading opening 36, and a rearward body section 32. Hopper 34 can include an optional hopper wind screen extension 38, as shown, as well as a protective shield 28 at the forward end of the body to minimize wind forces on refuse within the hopper. With the frontloader, two-body section embodiment, hopper 34 should be narrow enough to accommodate one or two arms at its side(s), but wide enough to enclose container 33, so it preferably has flat or nearly flat walls. Body section 32 preferably has curved walls to better withstand the stresses involved in compacting the refuse load. In other embodiments, however, curved walls need not be used, and a single-section body can be utilized, as well. Preferably, the cab is an unmodified, full-sized cab, but "half-cabs" could also be used in other, non-preferred embodiments.

Figure 4:
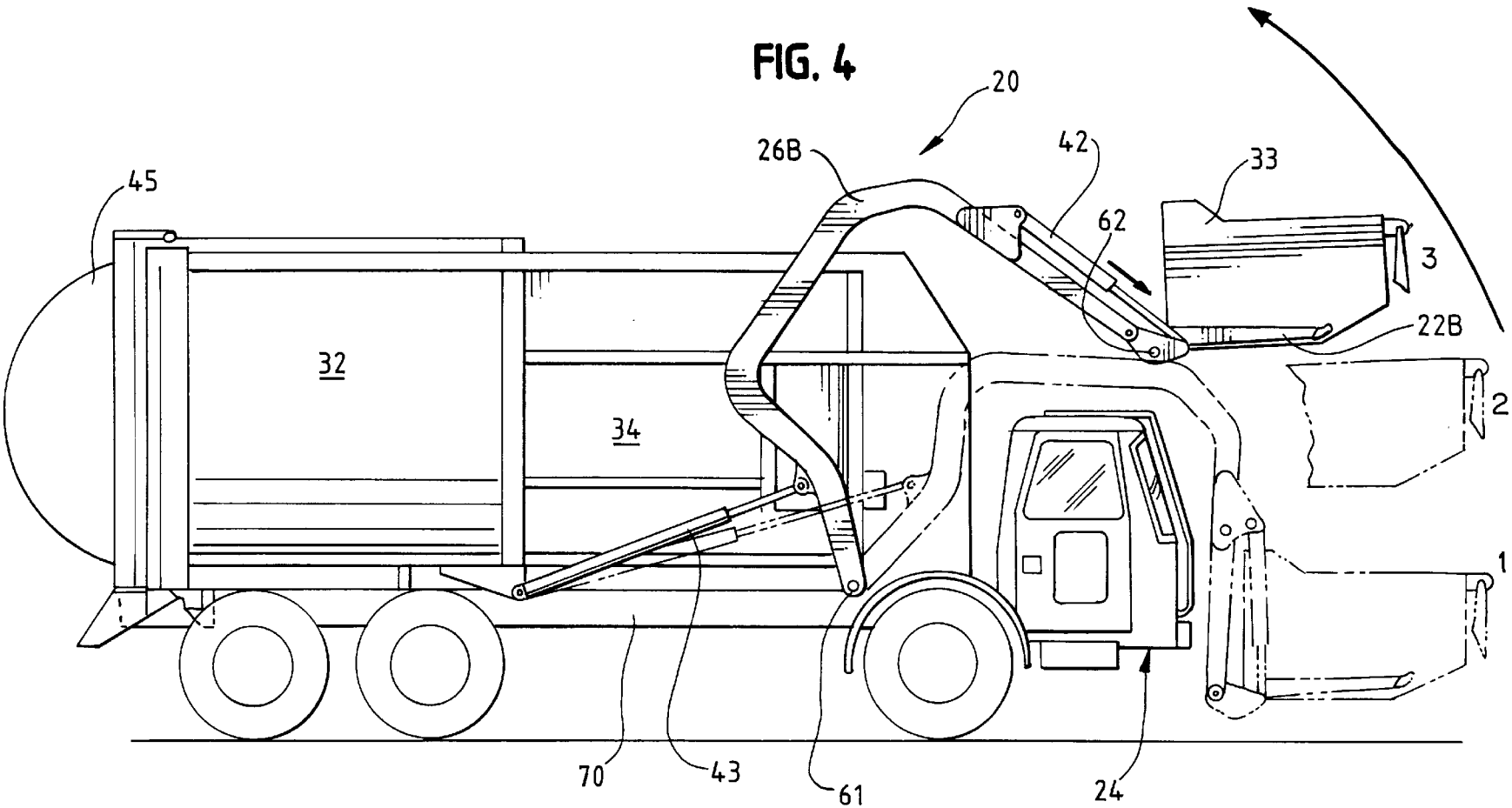
FIG. 4 is a side view of the refuse vehicle shown in FIG. 1, showing a first portion of the container dump cycle.

Arms 26A, 26B are pivotally connected at pin 61 (FIG. 4) located at a forward section of hopper 34. Alternatively, arms 26A, 26B could be connected to vehicle chassis 70. Rotation of the arms is driven by arm cylinder(s) 43 (only the cylinder associated with near lift arm 26B is shown in the drawings). Arms 26 can be driven by a variety of mechanisms, such as hydraulic cylinders or other actuators. Forks 22A (not shown) and 22B are pivotally connected at pin 62 to the ends of arms 26A, 26B, respectively. Rotation of the forks is accomplished by fork cylinders 42 (only one shown). The coordinated rotation of lift arms 26A, 26B and forks 22A, 22B moves container 33 through dump and return cycles, as described more specifically below.

Figure 9:
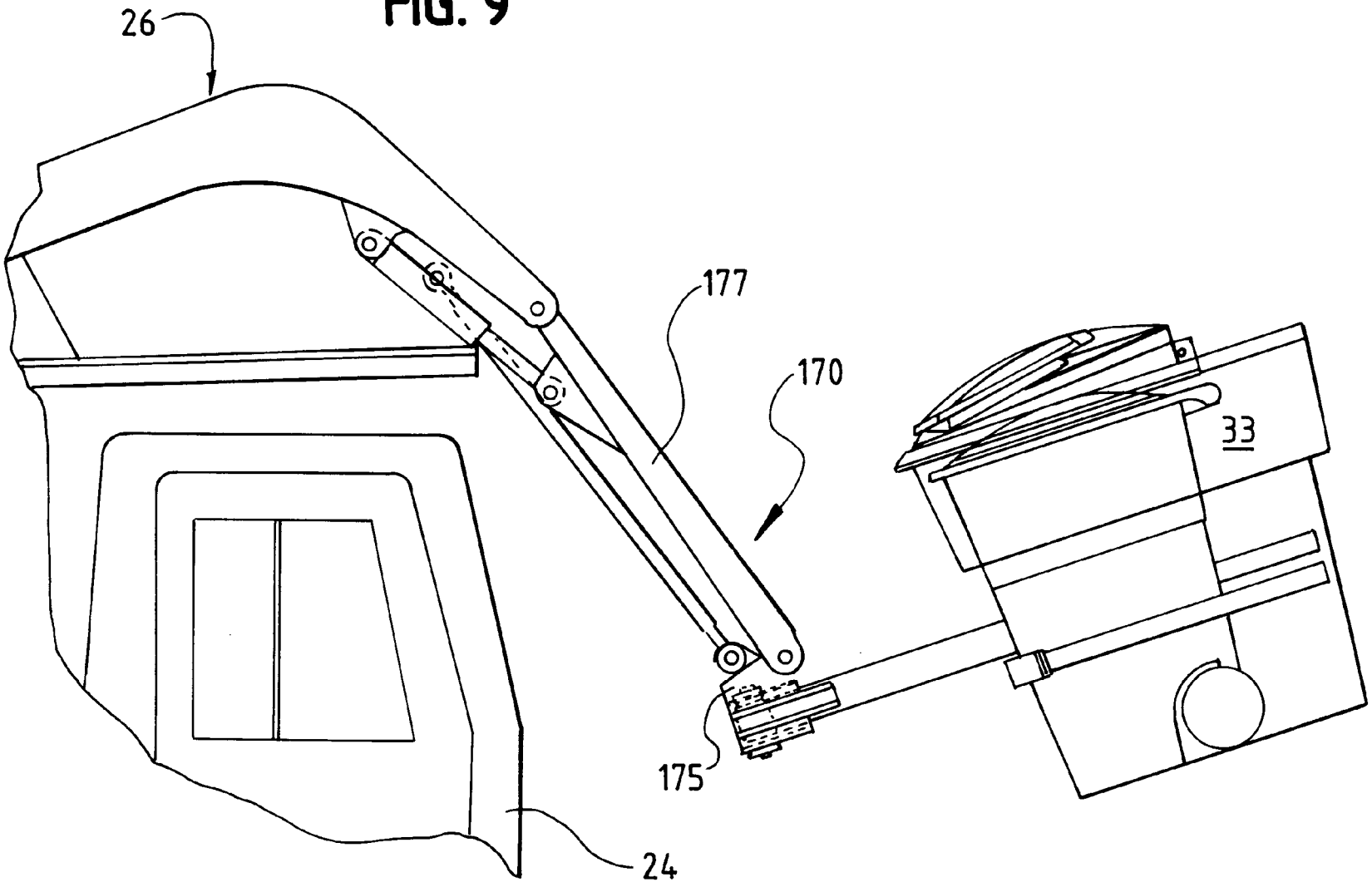
FIG. 9 is a partial side view of an alternative embodiment of the present invention using a folding lift arm.
Figure 10:
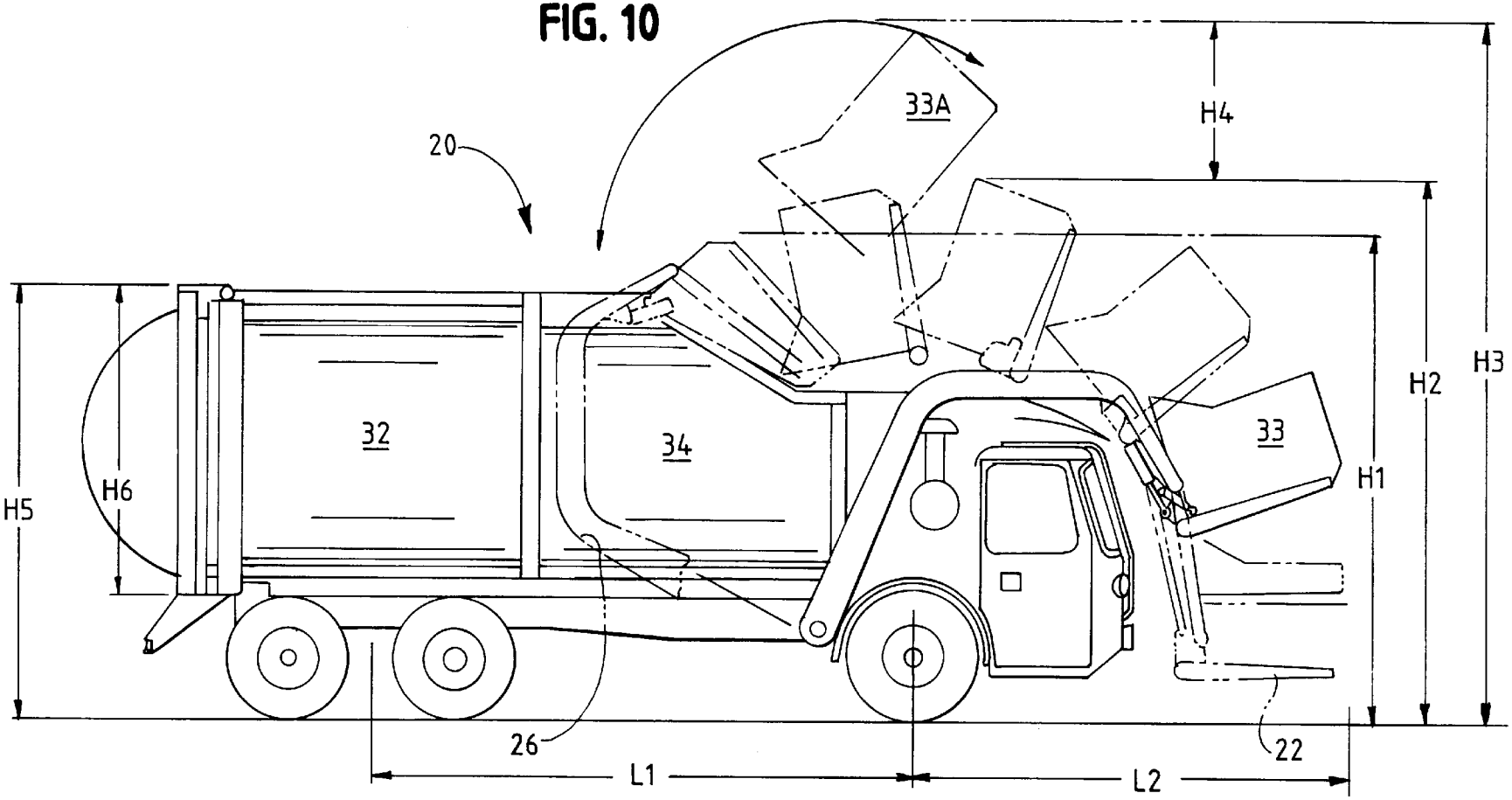
FIG. 10 is a side view of a preferred embodiment of the refuse vehicle employing the folding lift arm shown in FIG. 9.

The arms are preferably generally U-shaped, as shown in the drawings, to accommodate a full-sized cab; however, in non-preferred embodiments the arms can take other shapes which are expedient given the design parameters. In a particularly preferred embodiment, disclosed in commonly-assigned, co-pending U.S. Ser. No. 08/562,394, filed Nov. 24, 1995, the contents of which are hereby incorporated by reference herein, the automated refuse vehicle is preferably "low profile" in the sense that the lift arm does not exceed a relatively low, predetermined height "envelope" during lifting and dumping of the container. Thus, as shown in FIG. 9, use of the lift arm link assembly, designated generally as 170, which includes dump link or "knuckle" 175 and the four-bar linkage described in this co-pending application, enables the container to be rotated through 135°, which includes 90° of rotation due to the rotation of the lift arm about main pivot 61, and an additional 45° of rotation due to the clockwise movement of front link 177 with respect to lift arm 26. FIG. 10 illustrates the "low profile" features provided by this folding lift arm. H1 is the apex of the container height during dumping and transportation in the stow position. H2 is the apex of the container height during the dump cycle using the folding lift arm. H3 is the apex of the container height during the dump cycle using a conventional lift arm. H4 is the difference in heights between H3 and H2. In the preferred embodiment, to give non-limited examples only, H1 is 13 feet, 6 inches; H2 is 15 feet; H3is 19 feet, 4 inches; H4 is 52 inches; H5 is 144 inches; H6 is 100 inches; L1 is 180 inches; and L2 is 146 inches. In addition to the low profile feature, in other embodiments it may be preferred to use a single arm, capable of lateral swing transverse to the body length, as also disclosed in co-pending U.S. Ser. No. 08/562,394.

Figures 2, 3:
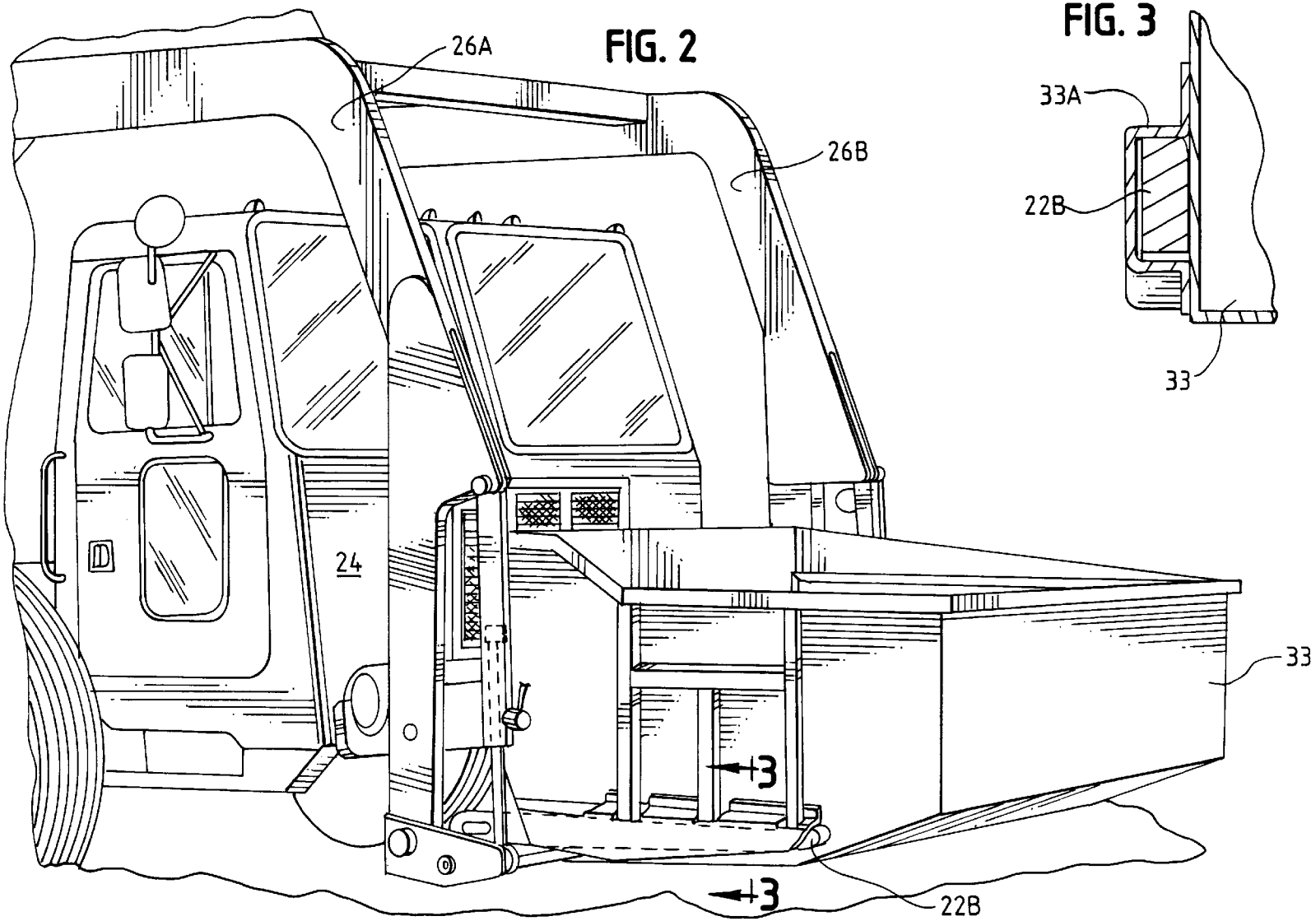
FIG. 2 is a partial side and front perspective view of the refuse vehicle shown in FIG. 1.
FIG. 3 is a cross-sectional view taken along section line 3—3 of FIG. 2.

Container 33 is preferably a lightweight container specifically designed to mate to a fork system. As shown in FIGS. 2 and 3, forks 22A, 22B fit within corresponding pockets 33A on opposing sides of container 33. A retainer pin (not shown) can be used to quickly connect and disconnect the container from the forks. A rotating cart dumper 35 or other device can also be used to facilitate filling of the container with refuse. The container and cart dumper 35 are preferably designed to provide good driver-line-of-sight visibility, a low-profile loading height and good ground clearance.

Figure 5:
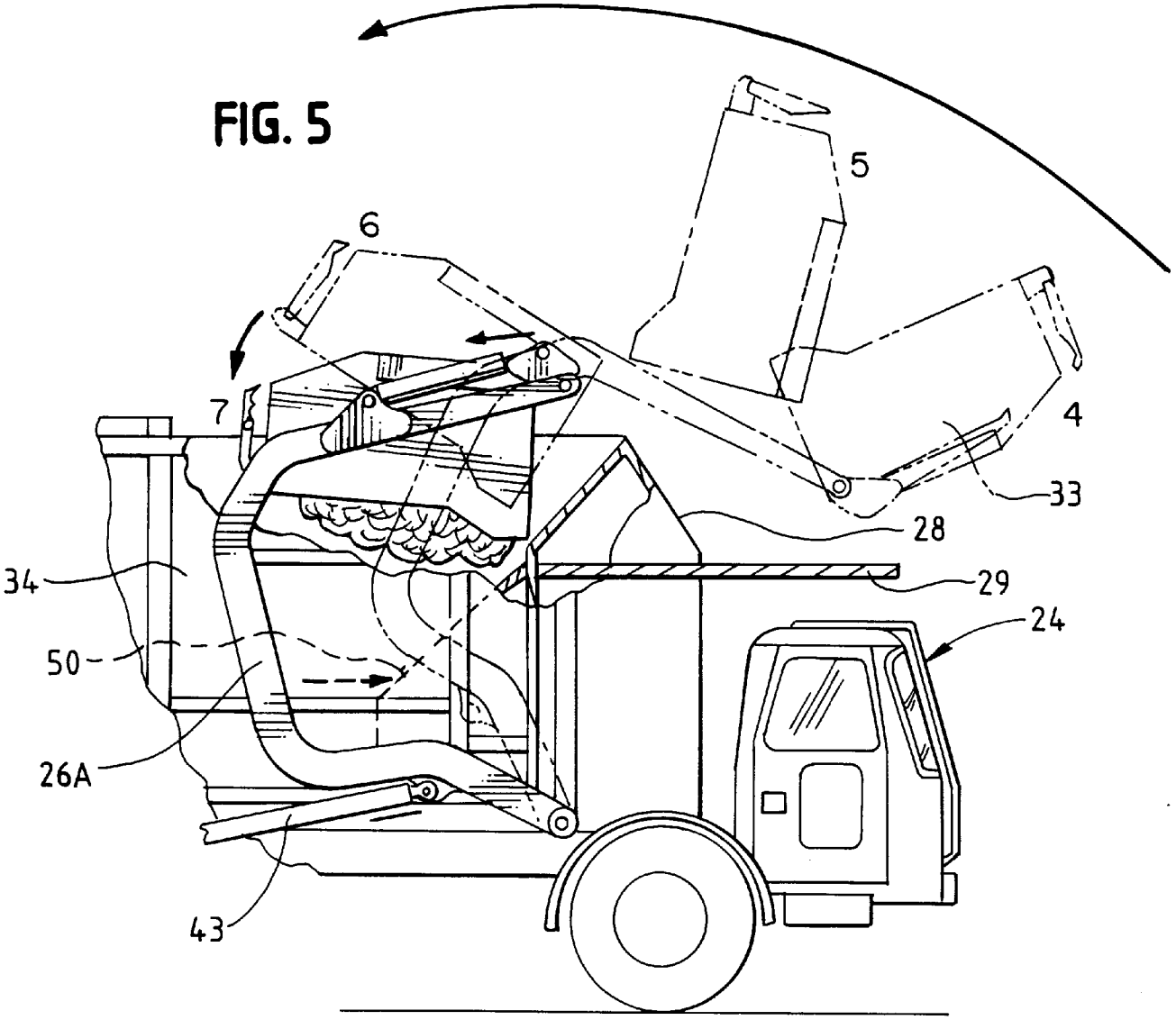
FIG. 5 is a partial side view similar to FIG. 4 showing a second portion of the container dump cycle.
Figure 6:
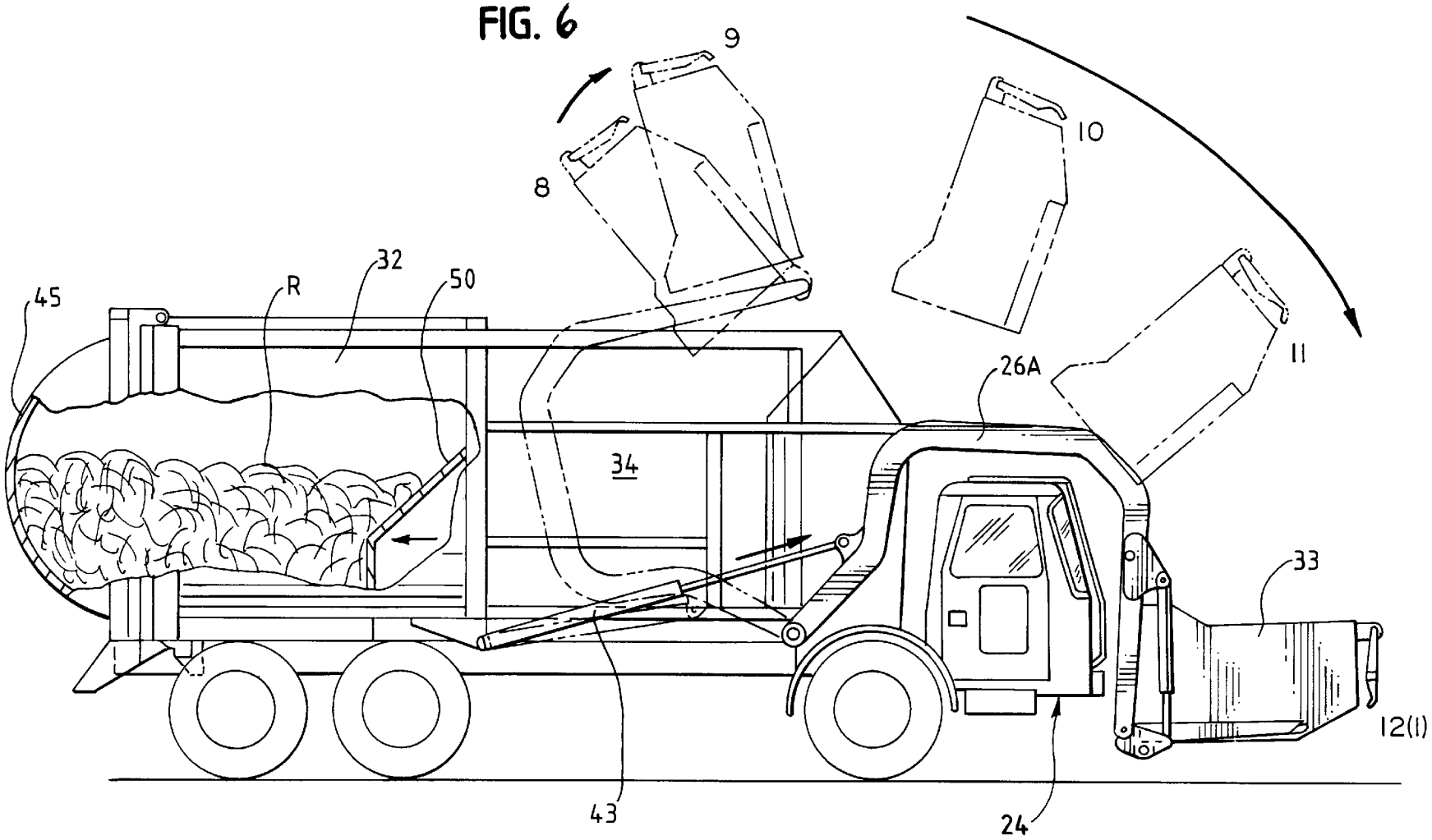
FIG. 6 is a side view similar to FIG. 4, in partial cross-section, showing the container return cycle.

Referring now to FIGS. 1, 5 and 6, body 30 includes a packer ram or ram 50 and associated packer cylinders 50A, 50B. These cylinders can take various forms, but with a refuse vehicle with an "eject" (as opposed to a "dump") mode of removing collected refuse from the storage body, the packer cylinders are preferably two-stage telescopic packing/eject cylinders; such cylinder may include (as one example only) spherical bearings and melonite nitriding process sleeves. With regard to the general operation of packer ram 50, as is conventional the packer ram remains in hopper 34 during compaction of collected refuse. Only upon ejection (see FIG. 6) does the packer ram move rearward of hopper 34 and into body section 32, adjacent "bubble" tailgate 45. Other aspects of the operation of the packer ram are not conventional, and will be described below.

It will be understood from the following disclosure that many benefits are realized by the present invention. Some of these benefits include:

(a) increased payloads, since the packer system maintains maximum packing forces on the materials over a programmable time period (the "creep" mode);

(b) continuous monitoring of and feedback control over the arms, forks and the packer ram, so that their positions are always known by the control system;

(c) a control system which enables the use of an integrated, automated, high-speed loading system of the arms, forks and carry-can to provide efficient, safe and error-free loading into the storage body;

(d) a control system which simultaneously operates the arms and forks to provide a smooth, continuous lift cycle, to effect spill-proof dumping of refuse in one smooth lifting cycle;

(e) a control system permitting the use of operator controls which provide continuous dump and return cycles using a single switch, with a fast-return sequence;

(f) the use of only a single operator to both load and drive the unit;

(g) a low profile refuse vehicle, particularly if a folding or "knuckle" lifting arm is used, and also since the container can be stored within the hopper during transport in a "stow"

position, so that the presence of the container does not affect the effective transport height or length of the vehicle; and (h) a control system with a series of "lock-out" zones which prevent container/cab/chassis/body interference during "dump" (defined here as container movement through positions 1–6 of FIGS. 4-5) and "return" (defined here as container movement through positions 7 to 6 of FIG. 5, plus positions 8–12 of FIG. 6) cycles.

The function and operation of the packer ram, and the "lock-out zones" for the arms and forks, will now be generally described. This general description will then be followed by a more detailed description of the electrical and hydraulic control systems of the particularly preferred embodiment of the present invention.

THE COMPACTING SYSTEM

The compacting system of the present invention need not be limited to use with refuse vehicles; instead, the principles involved are envisioned for use with any packing devices, including stationary packers or those employing multiple packing panels, blades or rams.

In the preferred embodiment, packer ram 50 reciprocates within hopper 34 to compress refuse within the body. The control system for the packer ram (described in detail below) continuously monitors the position of the packer ram, and causes the packer ram to automatically reverse directions whenever its fully extended position is reached, defined here as the "packing point" or "packing position", or when the forward "home" position is reached. The control system is adjustable to limit the flow rate to the actuator cylinders, reducing horsepower requirements in either direction. The control system is also programmable to allow a cushioned deceleration and acceleration whenever a reversing motion is activated or imminent.

In operation, the packer ram control system continuously monitors the rate of movement of the packer ram/blade, and detects a change in rate of either the extending or retracting movement of the packer ram. The control system also maintains the continued uninterrupted movement of the packer until the rate of movement is completely stopped (due to the growing compacting force on the load), or the rate of movement is less than a predetermined (pre-programmed) rate. At this point, the control system has placed the packer ram in a mode, defined here as the "creep" mode, in which full power is maintained on the packer ram for a pre-programmed time interval, such as 5 seconds (during which time the packer ram may continue to slowly move in the direction of the compacted refuse, or "creep"), after which time the packer ram will automatically reverse its direction. Packer ram return can, alternatively or conjunctively, be initiated whenever the arms are being raised. If, during creep, the packer ram reaches its packing point, it will reverse its direction and return to the home position; if it does not, the packer ram will hold its position (or continue to creep forward) for the pre-programmed interval before returning to the home position. Once the "creep" mode has been initiated, the operator can be apprised of this fact through the use of an indicator light, or other means.

It is possible for the packing ram, once it is in the creep mode and the pre-programmed interval has begun, to speed up again, faster than the pre-programmed rate of movement. If this occurs, the "clock" will be reset to zero, and the pre-programmed interval will only begin again if the rate of movement of the packing ram again goes below the pre-programmed rate.

The compacting system of the present invention is also a dual-direction system. Thus, as mentioned above, the packer ram can be placed in the "creep" mode by the control system when the ram is either extending or retracting. Sometimes, when the packer ram is retracting back to the "home" position, it may fail to reach the full forward portion of the hopper due (for example) to the presence of refuse in the path of the ram. If this occurs, the packer ram will initiate the "creep" mode, the pre-programmed interval will begin, and then shift to the extending cycle. Thus, the control system of the present invention provides more efficient compaction in two directions.

Continuous monitoring of the rate of movement of the packer ram, as well as the arm(s) and fork(s), can be accomplished in various ways, but in the preferred embodiment rotary potentiometers available from Williams Controls of Portland, Oreg. are used. Three rotary potentiometers (not shown) are used: one is located at the pivot connection of the forks to the arms; a second is located at the pivot connection of the arms to the body; and a third is associated with the packer ram cylinders. Space limitations has rendered the use of such devices impractical in the past. However, it was discovered that the rotary potentiometers need not be mounted on the axis of rotation of the arms, forks and packer ram, but can instead be mounted off-axis, using linkage and levers (not shown) to provide rational position. As an example, the rotary potentiometer associated with the packer ram cylinders measures the rotation of the cylinders. This information is converted by the controller to a proportional distance to obtain the precise packer ram location. Similar or other feedback devices (such as sensor switches) can be positioned to detect the movement of the packer ram, arm or fork actuators. Preferably, however, the feedback device constantly monitors the position of the packer ram, arms and forks, as determined by their actuator (e.g., cylinder) position, so that the control system knows their location at all times.

Referring to FIGS. 1 and 5, packer ram 50 is equipped with a horizontal panel, follower cover 29, which is attached to the upper section of packer ram 50. Follower cover 29 extends out over cab 24, as shown, when packer ram 50 is in the forward position, and covers loading opening 36 when the ram is extended. Thus, when packer ram 50 extended to its packing point, cover 29 prevents refuse from falling behind the ram. Cover 29 is preferably a one-piece cover with a single hinge or flex point (not shown).

The preferred embodiment shown in the drawings employs an "eject" style of removing collected refuse from the storage body. Thus, during collection and compaction, the packer ram can be designed to only extend and retract within the hopper. However, when refuse is to be ejected and the tailgate is open, the packer ram can be permitted to extend past the packing point, to a position adjacent the tailgate. The compacting system of the present invention can also be advantageously used with "dump" style vehicles in which the storage body is inclined and refuse exits the body under the influence of gravity. With this style, piston cylinders are used to drive the packer ram, rather than telescopic cylinders, and the packer ram typically does not travel past the packing point.

As will be seen from the disclosure below, benefits realized by the improved, automated packing system include: increased payloads resulting from the use of a (e.g.) 5-second creep mode; reduced wear on hydraulic body/packer components; reduced noise levels; continuous packing cycles with low horsepower; and longer chassis life (due to reduced horsepower loads on the chassis); less fuel consumption; reduced over-all wear; elimination and/or reduction of electrical components; and reduced spillage of materials.

"NO GO"/LOCK-OUT ZONES FOR ARMS/FORKS

When the refuse vehicle of the present invention is operated in the automatic mode, the movement of the arms and forks is confined to three lock-out zones, to avoid damaging the unit. These lock-out zones are pre-programmed to eliminate any possibility of interference of the arms, forks or container with: (i) the cab; (ii) the body; (iii) the ground; or (iv) any packing mechanism, without regard to whether the operation is being performed in "automatic" or "manual" modes.

Thus, in "lock-out zone 1", with the container positioned forward of the cab, the arms and forks are not permitted to rotate such that the container could be rolled into contact with the cab. In "lock-out zone 2", with the container again forward of the cab, the forks cannot be rotated below ground level. In "lock-out zone 3", with the container in the "dump" position (i.e., the container is in position "7" of FIG. 5), the arms cannot be rotated forward to permit the forward portion of the container to contact a forward portion of the body (e.g., packer cover 28).

The lock-out zones are pre-programmed, and will avoid undesirable contacts regardless of the relative position of the arms and forks. As an example, in lock-out zone 2, when the vehicle is operated in the "automatic" mode the forks will not be permitted to contact the ground, whatever the relative height of the container above the ground. This can be done because the control system continuously evaluates the positions of both the arms and forks.

THE CONTROL SYSTEM

The function of the hydraulic and electrical circuits of the preferred embodiment is disclosed below. Preferably, a digital electro-hydraulic valve control system is used which provides position-feedback for the arms, forks and packer ram. One controller that can be used is known as the Digitrak™ motion control system, available from Commercial Intertech of Youngstown, Ohio. The Digitrak™ system is an advanced motion control system for open- and closed-center hydraulic circuits. It includes a microprocessor, valves which are positioned in response to a digital command, and a stepper motor to control spool movement. One benefit of this system is that control of the valve spool's position is independent of pressure and flow. Because the stepper motor provides a continuous digital representation of the valve spool's position, the microprocessor knows the location of the spool without the need for expensive or complex feedback. The position of the controlling valve's spool is also inherently known with this system.

HYDRAULIC LAYOUT FOR PREFERRED EMBODIMENT

Figure 7:
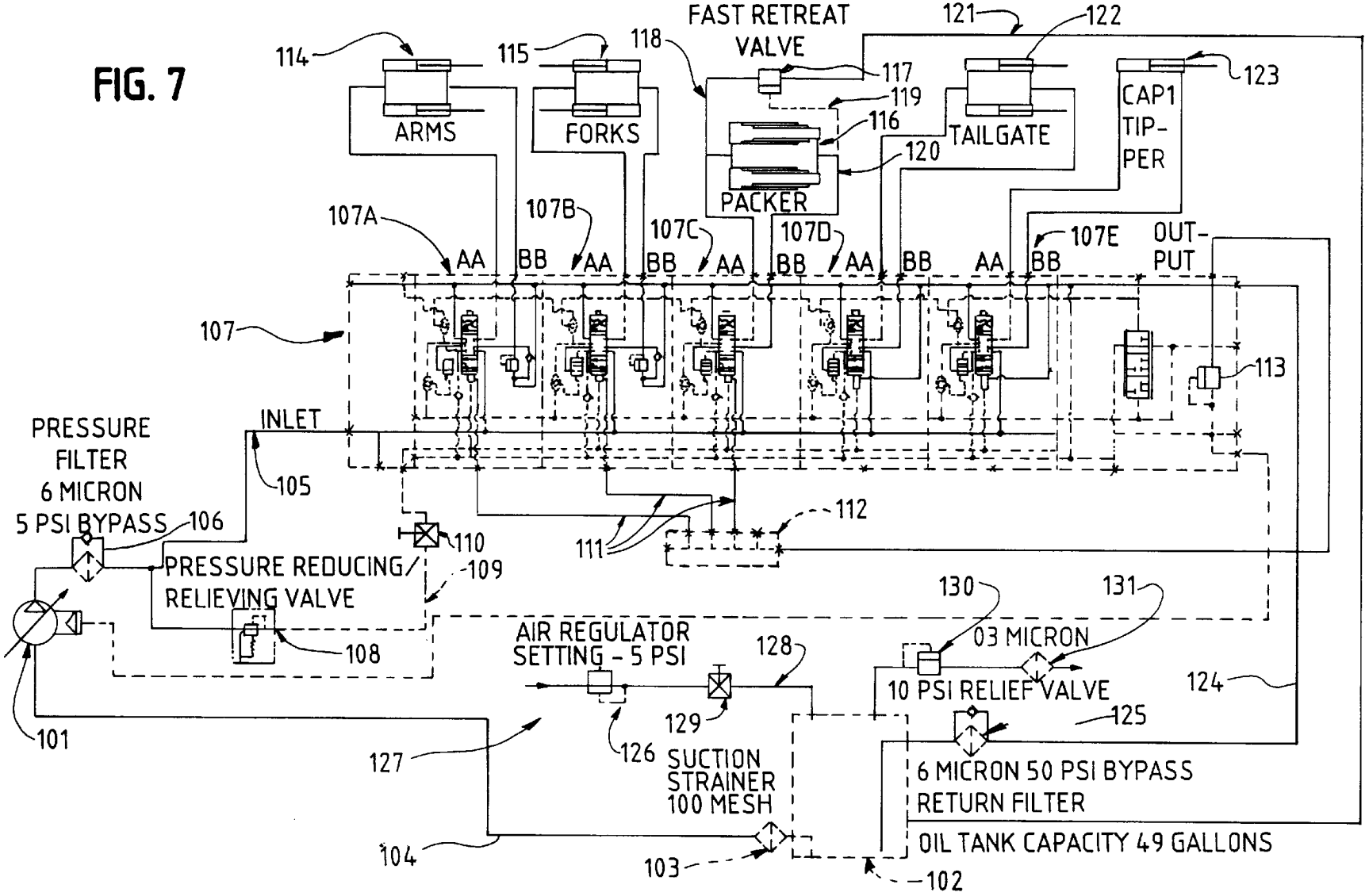
FIG. 7 is a schematic view of the hydraulic layout for a preferred embodiment of the present invention.

In the preferred embodiment, the hydraulic circuit shown in FIG. 7 includes a variable displacement pressure-compensated piston pump 101. Oil reservoir 102 includes a suction strainer 103 (e.g., 100 mesh) for general filtration of the oil before it is drawn into pump 101 through suction line 104. High pressure oil is delivered by the pump through HP line 105 after passing through an HP filter 106 (e.g., 6 micron, 50 psi bypass) between the pump and main control valve 107. High pressure fluid is also delivered to a pressure reducing valve 108, which delivers pressure through pilot line 109 to control valve 107. (Thus, load-sensing hydraulic packing cylinders 50A, 50B therefore use, for example, only 2500 psi main pressure.) This pilot pressure is used, internal to main control valve 107, to shift the individual spools as activated by their individual spool controllers. A shut-off valve 110 is provided in pilot line 109 for service shut-off of the pilot flow.

Oil is returned from main control valve 107 via a return line 124 which delivers the return oil through a return line filter 125 (e.g., 6 micron, 50 psi bypass return filter), before entering oil reservoir 102.

Load sense lines 111 are tied together through a manifold block 112, and piloted to the load sense relief 113 of main control valve 107. Load sense relief 113 will control maximum pressure delivered during any function.

Main control valve 107 is divided into individual control sections 107A–107E. These sections control flow to and from individual working cylinder groups via section work ports "AA" and "BB". The function of these control sections is now described:

Control Section 107A: Control section 107A provides oil to a set of hydraulic cylinders 114 to rotate the lift arms up and down. Retraction of lift cylinders 114 causes the lift arms to rotate up, and extension of lift cylinders 114 causes the arms to rotate down.

Control Section 7B: Control section 107B provides oil to a set of fork cylinders 115. The extension of fork cylinders 115 causes the forks to rotate downward, while retraction of the fork cylinders causes the fork cylinders to rotate upward.

Control Section 7C: Control section 107C provides oil to a set of packing cylinders 116, shown (FIG. 1) as telescopic double-acting hydraulic cylinders. Packing cylinders 116 may also be single stage piston cylinders, if a "dump" rather than an "eject" style vehicle is used, for example. Extension of packing cylinders 116 causes packer ram 50 to extend rearward, from a forward position in the body, and compress material in the body. Retraction of packing cylinders 116 causes packer ram 50 to travel forward to its original position.

Control Section 7D: Control section 107D provides high pressure oil to a set of tailgate cylinders 122. Tailgate cylinders 122 power body tailgate 145 (not shown) to open, closed and locked positions. Tailgate cylinders 122 are normally simple double-acting hydraulic piston cylinders.

Control Section 7E: Control section 107E provides high pressure oil to a device such as optional roll-out cart tipper 35. The optional cart tipper may be powered by a cart tipper cylinder 123 or another hydraulic powering mechanism.

Fast retract valve 117 is tied into the packer extend hydraulic line 118. Valve 117, typically a pilot-operated check valve, has a pilot line 119 tied into packer retraction line 120. When control valve section 107D is providing oil to the retract port of packing cylinders 116, pilot pressure in line 119 will open fast retract valve 117, allowing oil to return to tank in line 121 and through regular return port "AA" in control section 107D. By providing two paths to tank, the large flow of oil to be returned to tank during retraction of the packer panel can be returned to tank 102 with minimal pressure losses, thus providing a high speed return cycle for the packing ram.

Oil reservoir 102 is pressurized by tying into the chassis air supply system, generally referred to as 127, and limited to a low pressure by an air pressure regulator 126, and to the enclosed tank through air conduit 128. A shut-off valve 129 is provided for servicing. Due to the potential of a greater rate of fluid being returned from the hydraulic system than the rate fluid is drawn out of the system by the pump (due to the retraction of the hydraulic cylinders and their inherent volumetric differences between rod and base sides), a 10 psi relief valve 130 is provided to allow air to escape the enclosed oil reservoir 102 and to prevent high pressure air entrapment in the reservoir. A 3 micron air filter 131 is also provided to filter any incoming air that may be present at start-up, or when the internal tank pressure may be lower than atmospheric pressure.

To summarize the operation of the hydraulic system, and as indicated above, each hydraulic valve section controls an independent set of cylinders which, in turn, controls a separate piece of equipment (e.g., forks, lift arms, cart tipper) on the vehicle. Electrical and/or manual controls provide input to each of the valve sections, permitting separate or simultaneous operation of the individual valve sections and sets of cylinders. As will be appreciated, in this preferred hydraulic system there are no automatic ties or simultaneous operations of hydraulic functions other than those caused by control selection. Instead, each valve section operates a single set of cylinders (e.g., one valve section is dedicated to the packer cylinders, one for the arm cylinders, etc.).

ELECTRICAL SYSTEM FOR PREFERRED EMBODIMENT

Figure 8:
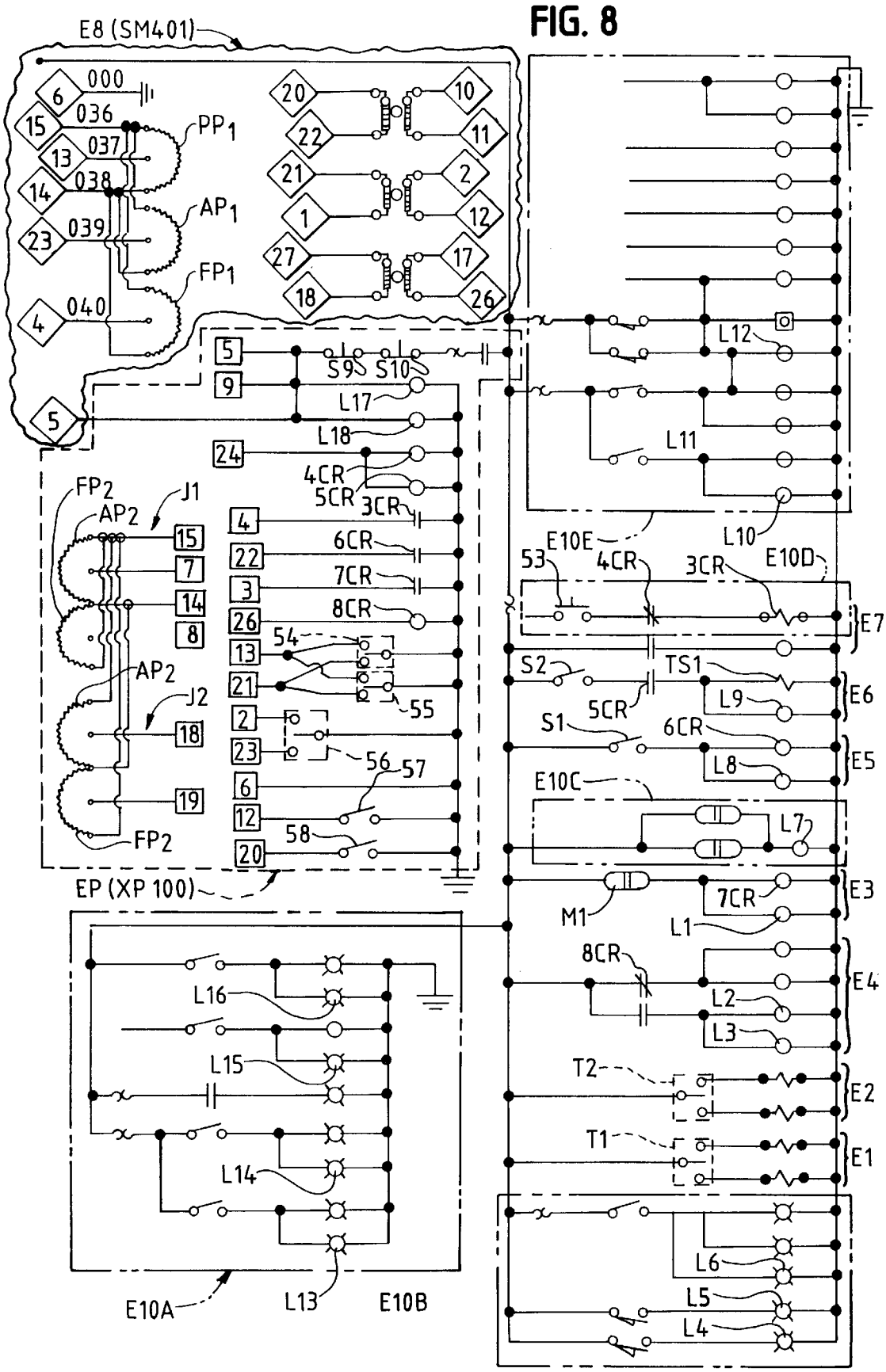
FIG. 8 is a schematic view of the overall electrical layout for a preferred embodiment of the present invention.
Figure 8B:
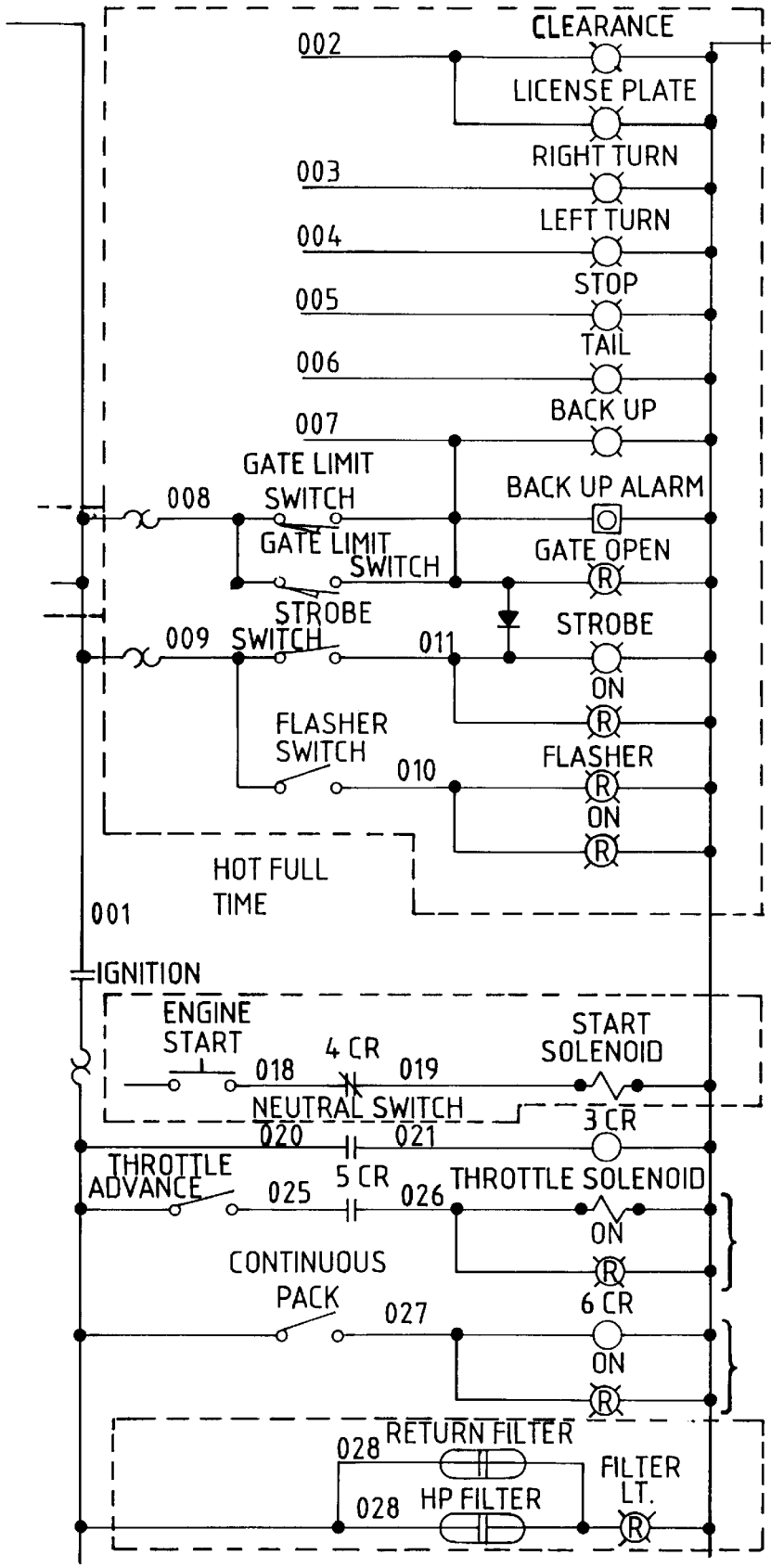
Figure 8C:
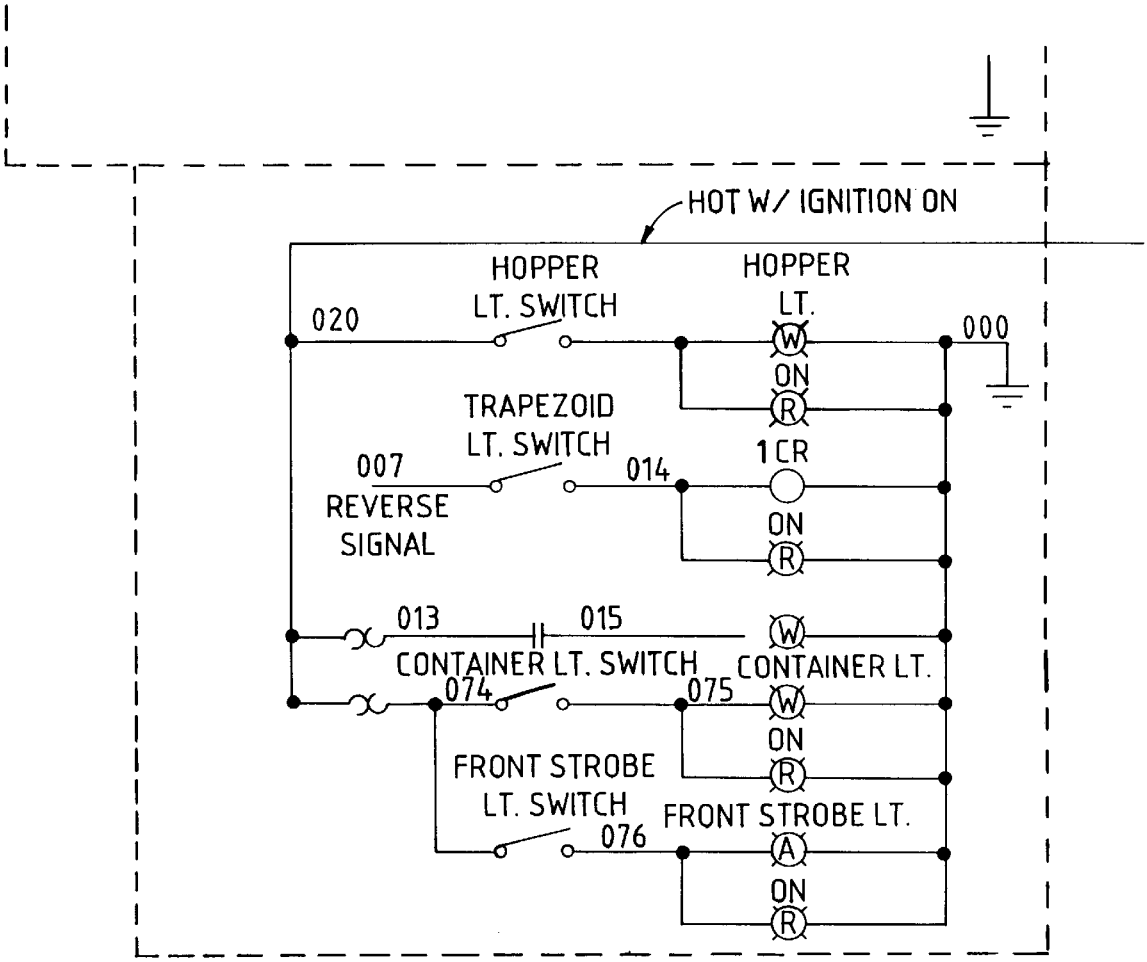
Figure 8D:
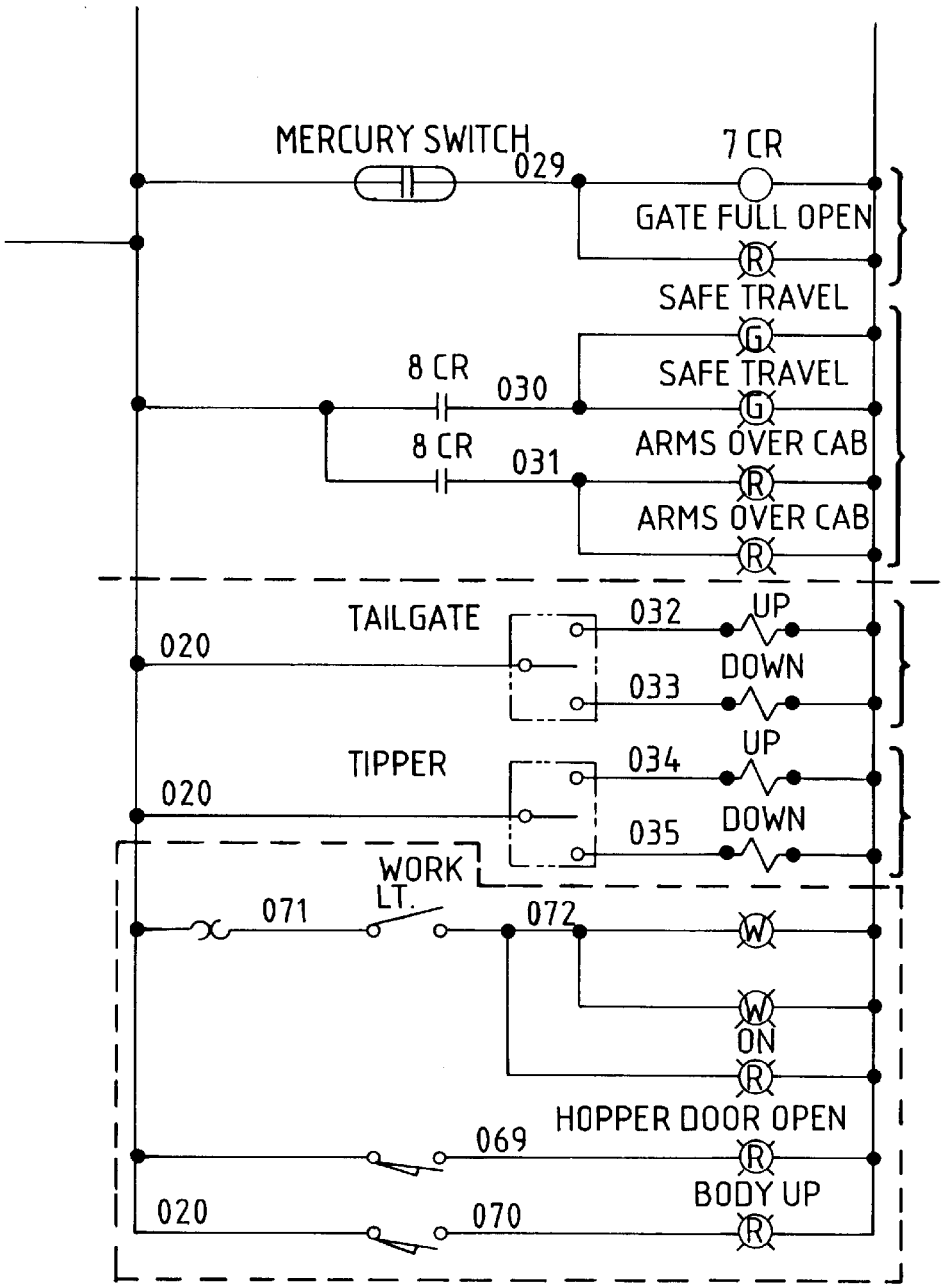
Figure 8E:
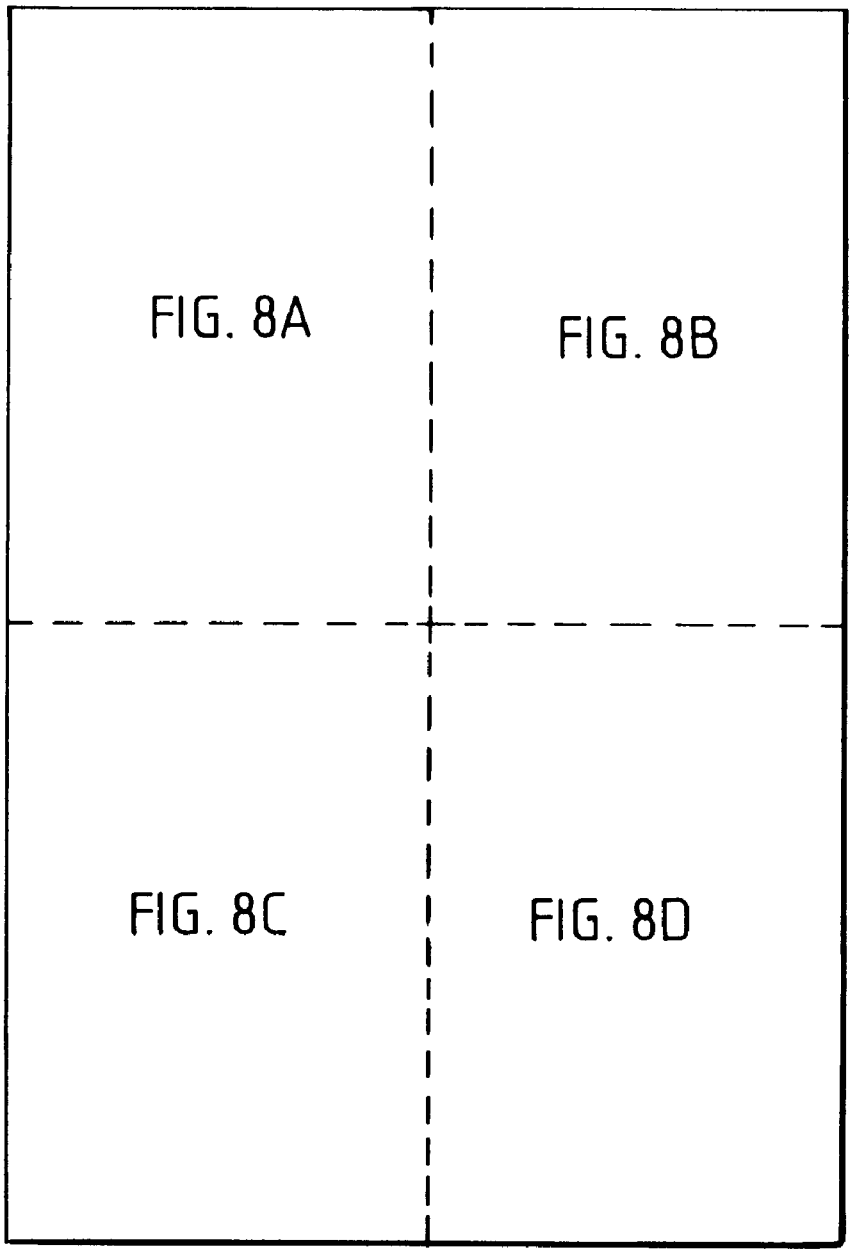
FIG. 8E is a diagrammatic view showing how individual FIGS. 8A–8D fit together.
Figure 8F:
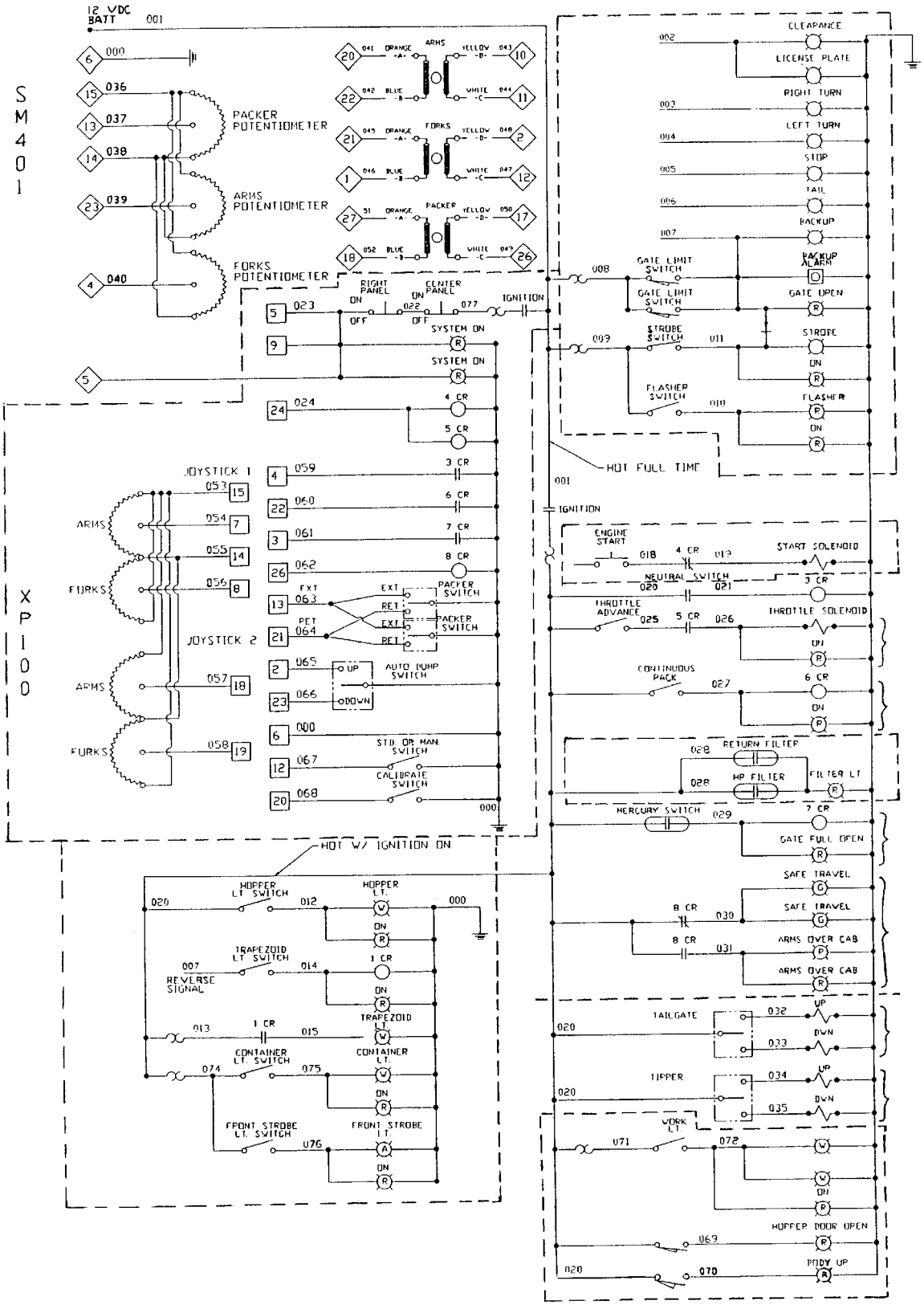
FIG. 8F is a more detailed view of the overall electrical layout shown in FIG. 8.

Referring now to FIGS. 8 and 8A–8F, the general operation of the electrical system will now be described. In general, the areas E10A–E10E outlined in phantom line on FIG. 8 include general lighting, control lamps and indicator lights. Area E9 outlined with a dashed line on FIG. 8 is controlled or tied to driver board XP100, which controls variables from potentiometers on the arms, forks and the packer ram. Area E8 outlined with a wavy line on FIG. 8 is controlled or tied to driver board SM401, which controls the hydraulic flow rate shifts of main valve 107. FIGS. 8A–8F are included for purposes of clarity and completeness, although it is not believed that they are necessary to obtain an understanding of the electrical circuitry required to be used to provide the various features of the present invention.

More specifically, the structure and function of the electrical layout in the preferred embodiment shown in FIG. 8 will now be described:

Area E1: Area E1 includes the solenoid valve controls for the optional cart tipper arrangement of valve section 107E of FIG. 7. The cart tipper is controlled by a simple momentary three-position rocker switch T1, to activate either the "up" or "down" valve solenoids.

Area E2: Area E2 includes the solenoid valve controls for the tailgate, which can be moved between open and closed/lock positions, using valve section 106E of FIG. 7. The movement of the tailgate is also controlled by momentary three-position rocker switch T2, to activate either the "up" or "down" valve solenoids.

Area E3: Area E3 includes a mercury switch M1 mounted on the tailgate, an indicator light L1 and a control relay 7CR. As the tailgate is rotated to its fully open position, the mercury switch closes, providing a 12 volt signal to the indicator light and relay 7CR. This relay is energized, closing the contact and providing a ground connection to contact C3 (referred to simply as "3" on FIG. 8, due to space constraints) of driver board XP100 (area E9). This ground signal provides a by-pass signal to the packer controls, allowing the packer ram to fully extend the telescopic cylinders, moving the packer ram rearwardly to the end of the body and ejecting the load. In the absence of this ground signal to contact C3, the packer ram movement will be limited to half-stroke, as controlled by the packer potentiometer feedback.

Area E4: Area E4 includes circuits for safe travel of the arms, and "arms over cab" indicator lights L2 and L3. Control relay 8CR is energized by a hot signal from contact C26 of driver board XP100, opening the N/C (normally closed) contacts and closing the N/O (normally open) contacts for relay 8CR, and lighting the appropriate indicator lights. Contact C26 of driver board XP100 provides a 12 volt signal whenever the arm potentiometer indicates that the arm is in a position that is over the legal road height limit of 13 feet, 6 inches.

Area E5: Area E5 includes indicator light L8 and a two-position selector switch S1 to select the "continuous pack" mode (described in more detail below). When switched to the "on" position, the packing cycle begins: first, the packer ram retracts to its forward-most position, and then it reverses to extend to the normal "pack position". This cycle continues during vehicle operation. Control relay 6CR is energized during this cycle, closing the N/O contacts, grounding contact C22 of driver board XP100, and providing continuous pack circuitry from driver board XP100.

Area E6: Area E6 includes throttle advance two-position selector switch S2, indicator light L9, throttle advance solenoid TS1 (which energizes to advance the engine throttle), and N/O contacts 5CR. Control relay 5CR is energized by a 12 volt signal from contact C24 of driver board XP100 whenever the "auto arm" cycle control is shifted to either the "raise" or "lower" positions. N/O contacts 5CR are closed, energizing the throttle solenoid TS1, and advancing the engine RPM for the "auto arm" raise cycle.

Area E7: Area E7 includes control relay 3CR, transmission neutral switch S3 and N/C contacts 4CR. When the transmission is in neutral, neutral switch S3 is closed, energizing relay 3CR. The N/O contacts 3CR close, grounding the output signal from contact C4 of driver board XP100, and allowing throttle advance only when the vehicle transmission is placed in neutral. Control relay 4CR is energized when contact C24 of driver board XP100 provides a 12 volt signal when the "auto arm" switch is activated, opening N/C contacts 4CR, and interrupting the circuit to the engine starter coil. By doing this, the engine cannot be started if the throttle advance is inadvertently activated.

Area E8: Area E8 includes the controls output contacts for driver board SM401. These control the flow settings to the three spool sections of main control valve 107; these flow settings limit flow to the arms, forks and packer sections. Thus, driver board SM401 contacts control valve section solenoid S18/S27 and S17/S26 (simply referred to as "18", "27" etc. on the drawings due to space constraints) for the packer extend and retract coils. Similarly, driver board SM401 contacts control valve section solenoids S1/S21 and S2/S12 for the extend and retract coils for the forks, and solenoids S22/S20 and S10/S11 for the extend and retract coils for the arms. Contact 000 provides the main ground point for driver board SM401. Area E also includes the packer, arm and fork potentiometers $PP_1$, $AP_1$, $FP_1$, respectively, and their common 5 volt (DC) input contact C15, common ground C14 and individual output signal contacts C13, C23 and C4. Output signals from each of the potentiometers are fed to driver board SM401, continuously indicating the position of each of the forks, the arms and the packer ram.

Area E9: Area E9 includes the contacts for driver board XP100, various input switches (including packer switches 54 and 55, auto dump switch 56, manual override switch 57, and calibrate switch 58), control relays 3CR–8CR, and related contact sets. Driver board XP100 controls the outputs as determined by the variables from the potentiometers in Area E8.

There is a common 5 volt feed running from contact C15 to the arm and fork joystick potentiometer controls $AP_2$, $FP_2$. The common ground contact is C14. Contact C6 is a master board ground. Outputs from the control potentiometers are C7 ("arms up"), C18 ("arms down"), C8 ("forks up") and C19 ("forks down").

Contacts C5 and C9, and control valve section solenoid 5 are the master hot feeds for driver boards XP100 and SM401, respectively, and are hard-wired in series with two N/C switches S9 and S10. These switches act as emergency stops which will stop all power and activities when either switch is interrupted. Lights L17, L18 are provided to indicate when the system is powered "on" or "off".

Two 3-position momentary switches 54, 55 are provided to control the extension and retraction of the packer ram in a "manual" mode. One switch is provided for easy access at each driver's position in the cab. Closing the contacts provides a ground circuit to contact C13 to extend the packer, or to contact C21 to retract the packer.

A 3-position momentary switch 56 is also provided to control the "auto arm" dump circuit. Closing this switch provides a ground circuit to contact C2 to raise the arm, or to contact C23 to lower the arm. This function automatically raises the arm, while maintaining the container in a level condition, and coordinates the dump motion of the arms and forks, including throttle advance.

Two-position switch 57 is provided to allow the operator to select between the "auto arm" lift cycle and a manual cycle. The auto cycle is deactivated unless the two-position switch providing ground circuit to contact C12 is in the automatic position. Calibration switch 58 is provided to ground contact C20 for service and calibration of set points. When grounded, all automatic functions of the system are de-energized.

THE STANDARD MODE OF OPERATION

The control system of the preferred embodiment shown in the drawings has two "standard" modes of operation: an "automatic" mode actuated by a single rocker switch control, and a "manual" mode actuated by either of 2 driver-side joysticks. Each "standard" mode of operation will now be described below. In general, in the standard automatic mode, movement of the rocker switch will automatically initiate the dump and return cycle. In the standard manual mode, the operator can control arm and fork movement using a joystick control, but cannot do so if such movement would cause the arm(s) or fork(s) to fall within the lock-out zones described above.

THE STANDARD MANUAL (JOYSTICK OPERATION) MODE

In the preferred embodiment, two joysticks J1 and J2 are provided for use, one for each driver side of a full-sized cab. Only one joystick is necessary to actuate the arm(s) and fork(s) combination through dump and return cycles. Using a joystick in the standard manual mode, the following functions occur:

(1) The cylinder endpoints are cushioned so that the operator cannot "bang" either the arm or fork cylinders hard into their endpoints.

(2) When the arms are in front of the cab in the "arms down" position, the forks are disabled from rotating up beyond a programmable point which prevents the container from contacting the cab, defined here as the "minimum cab clearance point". This point is considered by the program to be the minimum allowable forks retraction distance until the arms are in the "up" or "dump" position.

(3) When the arms are in a fully down position, forward of the cab, the forks are disabled from rotating down beyond a programmable point, defined here as the "forks ground contact point", which prevents the front of the container from moving too far below ground level.

(4) When the arms are "up" in the "dump" position, the forks must first be rotated out to the "minimum cab clearance point" before the arms are allowed to rotate down.

(5) An overheight indicator light turns "on" unless the arms and forks are in a position in which both sets of cylinders are fully retracted, defined here as the "stow" position, or if the arms are below a programmable point (defined here as the "overheight point").

(6) The first joystick operated will have priority over the other joystick. If one joystick fails the error is displayed but driver board SM401 does not shut down, and control will be retained over the other joystick. If both joysticks fails, driver board SM401 will shut down.

(7) The speed of operation of the arms and forks is slowed by a programmable percentage when operated by the joysticks. Otherwise, operations would be too fast for the operator to manually control. Also, this permits the operator to safely operate in the manual mode when there is a need for engaging different types of containers (i.e., container shapes and sizes which the control system was not programmed for).

(8) In the event of a sensor failure in either the arm or fork sensors, driver board SM401 will display the error and "disable all" functions.

THE STANDARD AUTOMATIC MODE

When the control system is placed in the standard automatic or "auto dump" mode, by selecting either of the "raise switch" or "lower switch" inputs on driver board XP100 and moving it to the "on" position, operation is as follows:

(1) Same as (1) in the "Joystick Operation" section, immediately above.

(2) The truck must be in neutral for the "auto dump" function to operate.

(3) When the container is full, the operator pushes and holds down the "up" button. The container will raise and dump. The operator must hold the button down for the entire "up" cycle; releasing the button will stop the motion.

(4) Before motion begins, the appropriate input on driver board XP100 will turn "on", raising the throttle speed to its high position in order to run the functions at maximum speed.

(5) The arms and forks follow a pre-programmed trajectory up to the dump position at maximum speed. This same trajectory is followed regardless of the starting point of the dump.

(6) The operator then pushes the "down" button and the container returns to a programmable starting position, using a different, more rapid path in which the container is not maintained in a level condition as it passes over the cab (see FIG. 6). Thus, in the preferred embodiment shown, while the dump and return cycles take a total of about 12 seconds in the automatic mode, the dump cycle takes about 7 seconds, whereas the return cycle takes about 5 seconds (since there is no need to maintain the container level over the cab on the return cycle). The operator must hold the button down for the entire down cycle, since releasing the button will stop the motion.

(7) Same as (8) in the "Joystick Operation" section, immediately above.

THE CONTINUOUS PACK MODE

The "continuous pack" mode is selected when the appropriate input on driver board XP100 is "on". The operation is as follows:

(1) The tailgate must be closed (the appropriate input on driver board XP100 must be "off") for the "continuous pack" mode to operate.

(2) There are programmable presets for "packer retracted", "packer extended", "packer full extend" and "continuous pack maximum" functions.

(3) When in the "continuous pack" mode, the packer operates continuously, without the need for operator intervention. When packing, the packer ram extends in a rearward direction until either a programmable setpoint (the "packing point") is reached, or until the packer pressure forces the movement to slow or stop. When the latter condition occurs, the packer operates in the "creep" mode and packer forces are maintained for a pre-programmed interval, such as 5 seconds. After the packing point has been reached, or following the pre-programmed interval if the packer ram is in the creep mode, the packer ram changes direction and begins retracting in a forward direction. The creep mode can be activated when the packer ram is either extending or retracting.

(4) There are two manual inputs on driver board XP100 for the packer: extend and retract. These inputs control packer ram movement as follows:

(a) When one of these inputs is activated, the "continuous pack" cycle is interrupted and the packer functions in the manual mode.

(b) When the "extend" input is activated, the packer cylinder extends all the way to the end unless the tailgate is closed; if the tailgate is closed, the packer cylinder will only extend to the programmable "extend" limit, and then it will stop.

(c) When the "retract" input is activated, the packer cylinder will retract.

(5) When the "auto dump" mode is engaged during a "continuous pack" cycle, the following operation will occur:

(a) if the packer is retracting, operation will continue as described above.

(b) if the packer is extending (packing), the packer ram will reverse (retract) until the "auto dump up" cycle is completed and the operator has pressed the "auto dump down" switch or released the "auto dump up" button. The packer ram will then begin extending (packing) again.

(c) if the packer is at a full retract position, the packer ram will pause until the auto dump raise is completed or stopped and the operator has released the auto dump switch.

(6) If the event of a sensor failure in the packer sensor, driver board SM401 will display the error and "disable" all functions.

(7) If the appropriate input on driver board XP100 is "off" ("continuous pack off"), the packer will only operate manually as described in step (4), above.

(8) If the continuous pack switch on driver board XP100) is "on" when the vehicle is started, the continuous pack function will not become active until the operator has toggled the switch "off" and then back "on". This is to ensure that the function does not operate by itself.

THE MAINTENANCE MODE OF OPERATION

In the preferred embodiment, the "maintenance" mode is selected when the appropriate input on driver board XP100 is turned "off". In the maintenance mode, all position sensor errors are ignored. The manual override mode of operation is provided as a means of emergency operation in the event of sensor failures only. The system operates in the manual override mode as follows:

(1) All automatic functions are disabled in manual mode. The cylinder endpoints are not cushioned, the minimum cab clearance point is inactive, the minimum forks ground level point is inactive, and the auto dump function is inactive. There are no automatic operator safety features active during manual override mode.

(2) The "continuous pack" function is still active unless there has been a packer position sensor failure. In this case, the packer will only operate in the manual mode.

(3) System errors other than feedback errors disable the system while in manual override mode. These errors include joystick failures, valve wiring failures, fuses, over/under voltage, etc.

(4) The maximum speed of the arms and forks function is decreased by some pre-programmed amount, such as one-half.

Use of the refuse vehicle of the present invention, and the attendant methods for waste collection which are provided by it, thus results in numerous advantages, many of which are mentioned above. It will be understood that the invention may be embodied in other specific forms without departing from its spirit or central characteristics. The present examples and embodiments, therefore, are to be considered in all respects as illustrative and not restrictive, and the invention is not to be limited to the details given here.

We claim:

1. A compacting system, comprising:

a packing mechanism adapted to compact refuse deposited within an enclosure, the packing mechanism being capable of extension and retraction between a predetermined packing point and a home position;

a feedback system for monitoring the rate of movement of the packing mechanism; and a programmable system for receiving data from the feedback system and controlling the movement of the packing ram;

wherein the packing mechanism is capable of operation in a creep mode in which, if the rate of movement of the packing mechanism is less than a pre-programmed rate of movement, the packing mechanism maintains a compacting force on the refuse in the direction of its original movement for a preselected time period or until the packing point is reached, whichever occurs first, after which the packing mechanism reverses its direction.

2. The compacting system of claim 1, wherein the packing mechanism is operable in the creep mode regardless of whether the packing mechanism is extending or retracting.

3. The compacting system of claim 1, wherein the creep mode is discontinued if the rate of movement of the packing mechanism increases above the pre-programmed rate of movement before either the preselected time period elapses or the packing point is reached.

4. The compacting system of claim 3, further comprising a counter, and wherein if the packing mechanism is operating in the creep mode and the rate of movement of the packing mechanism increases above the pre-programmed rate of movement, then the counter is reset and the preselected time period begins to run again only if the rate of movement of the packing mechanism again decreases below the pre-programmed rate.

5. The refuse vehicle of claim 1, wherein the programmable system includes a computer and moves the packing mechanism to an appropriate position depending upon certain information provided to the computer.

6. The refuse vehicle of claim 5, wherein the certain information includes information pertaining to the type of refuse being compacted.

7. The refuse vehicle of claim 5, wherein the certain information relates to the speed of the packing mechanism.

8. The refuse vehicle of claim 5, wherein the certain information is used to automatically position the packing mechanism depending upon the type of refuse.

9. A refuse collection vehicle, comprising:

a storage body with a loading opening for receiving refuse;

a packing ram located within the storage body and adapted to compact refuse deposited within the body, the packing ram being capable of extending to a predetermined packing point and retracting to a home position;

a feedback system for monitoring the movement of the packing ram; and a programmable system for receiving data from the feedback system and controlling the movement of the packing ram;

wherein the packing ram is also capable of operation in a creep mode in which, if the rate of movement of the packing ram is less than a pre-programmed rate of movement, the packing ram maintains a compacting force on the refuse in the direction of its original movement for a preselected time period or until the packing point is reached, whichever occurs first, after which the packing ram reverses direction.

10. The refuse vehicle of claim 9, further comprising at least one cover automatically positionable over the loading opening in response to movement of the packing ram.

11. The refuse vehicle of claim 9, wherein the refuse vehicle removes collected refuse by ejecting the refuse using the packing ram.

12. The refuse vehicle of claim 9, wherein the refuse vehicle removes collected refuse by raising the storage body to an inclined position, and allowing the refuse to slide out from the storage body under the influence of gravity.

13. A method for compacting refuse within the storage body of a vehicle during refuse collection, comprising the steps of:

a. providing a packing mechanism located within the storage body and adapted to compact refuse deposited within the storage body, the packing mechanism being capable of extending to a predetermined packing point and retracting to a home position;

b. providing a feedback system for continuously monitoring the movement of the packing mechanism;

c. providing a programmable system for receiving data from the feedback system and controlling the movement of the packing mechanism;

d. moving the packing mechanism, using the control system, to begin compacting refuse within the storage body;

e. if the rate of movement of the packing mechanism is less than a pre-programmed rate of movement, placing the packer mechanism in a creep mode in which a compacting force is maintained on the refuse in the direction of its original movement for a preselected time period or until the packing point is reached, whichever occurs first;

f. reversing the direction of the packing mechanism; and g. repeating steps (d)–(f) during refuse collection.

14. The method for compacting refuse of claim 13, further comprising the step of loading refuse within the storage body, the packing mechanism being retracted to the home position during loading, and being extended to compact refuse when loading is not occurring.

15. The method for compacting refuse of claim 13, wherein the packing mechanism is operable in the creep mode regardless of its direction.

16. The method for compacting refuse of claim 13, further comprising a counter, and further comprising the step that if the packing mechanism is operating in the creep mode and the rate of movement of the packing mechanism increases above the pre-programmed rate of movement, then the counter is reset and the preselected time period begins to run again only if the rate of movement of the packing mechanism again decreases below the pre-programmed rate.

* * * * *

UNITED STATES PATENT AND TRADEMARK OFFICE

CERTIFICATE OF CORRECTION

PATENT NO : 5,954,470

DATED : September 21, 1999

INVENTOR(S) : Charles A. Duell, et al

It is certified that error appears in the above-identified patent and that said Letters Patent is hereby corrected as shown below:

Title page,

Item [63], delete "Continuation-in-part of application no. 08/562394, November 24, 1995."

and replace with

-- Continuation-in-part of 08/562394, Nov 24, 1995, which is a continuation in-part of 08/482031, filed June 7, 1995, now patent no. 5,601,392, issued Feb 11, 1997, which is a continuation of 08/118564, filed Sept 9, 1993, which became U.S. Pat 5,470,187, issued Nov 28, 1995

Signed and Sealed this

Fourth Day of April, 2000

*Attest:*

*Attesting Officer*

Q. TODD DICKINSON

*Director of Patents and Trademarks*